US008550387B2

(12) United States Patent
Matlin et al.

(10) Patent No.: US 8,550,387 B2
(45) Date of Patent: Oct. 8, 2013

(54) RESTRICTIVE THROAT MECHANISM FOR PAPER SHREDDERS

(76) Inventors: Tai Hoon K. Matlin, Round Lake Beach, IL (US); James Waring, Libertyville, IL (US); Dmitry Romanovich, Wheaton, IL (US); Keeley Michael Kabala, Elgin, IL (US)

( * ) Notice: Subject to any disclaimer, the term of this patent is extended or adjusted under 35 U.S.C. 154(b) by 491 days.

(21) Appl. No.: 12/817,762

(22) Filed: Jun. 17, 2010

(65) Prior Publication Data

US 2010/0320297 A1 Dec. 23, 2010

Related U.S. Application Data

(63) Continuation-in-part of application No. 12/487,220, filed on Jun. 18, 2009.

(51) Int. Cl.
*B02C 4/32* (2006.01)
*B02C 7/14* (2006.01)
*B02C 9/04* (2006.01)

(52) U.S. Cl.
USPC ..... 241/36; 241/100; 241/101.3; 241/236

(58) Field of Classification Search
USPC ..... 241/36, 100, 236, 101.3
See application file for complete search history.

(56) References Cited

U.S. PATENT DOCUMENTS

| | | | |
|---|---|---|---|
| 2,221,516 | A | 4/1937 | Hathaway |
| 3,619,537 | A | 11/1971 | Nara et al. |
| 3,724,766 | A | 4/1973 | Bosland |
| 3,764,819 | A | 10/1973 | Muller |
| 3,785,230 | A | 1/1974 | Lokey |
| 3,829,580 | A | 8/1974 | Guetersloh |
| 3,947,734 | A | 3/1976 | Fyler |
| 4,192,467 | A | 3/1980 | Hatanaka |

(Continued)

FOREIGN PATENT DOCUMENTS

| | | |
|---|---|---|
| DE | 3313232 | 10/1984 |
| DE | 8619856.4 | 10/1988 |

(Continued)

OTHER PUBLICATIONS

Notification Concerning Transmittal of International Preliminary Report on Patentability (Chapter I of the Patent Cooperation Treaty), mailed Jan. 5, 2012.

(Continued)

*Primary Examiner* — Bena Miller
(74) *Attorney, Agent, or Firm* — Pillsbury Winthrop Shaw Pittman LLP

(57) ABSTRACT

A shredder including a housing having a throat for receiving articles to be shredded, a shredder mechanism, a blocking member, and an electrically powered motor and cutter elements. A thickness detector comprises a contact member extending into the throat. The shredder includes an actuator for moving the blocking member between a retracted position and an extended position. The actuator and the thickness detector are coupled to enable the actuator to move the blocking member from the retracted position to the extended position responsive to the movement of the contact member by insertion into the throat of the at least one article above a predetermined maximum thickness threshold. The blocking member is configured such that in the extended position the blocking member prevents further insertion of the at least one article into the throat, and in the retracted position the blocking member permits further insertion thereof into the throat.

4 Claims, 21 Drawing Sheets

(56) References Cited

U.S. PATENT DOCUMENTS

| | | | | |
|---|---|---|---|---|
| 4,352,980 | A | 10/1982 | Hibari | |
| 4,378,717 | A | 4/1983 | Schneider et al. | |
| 4,489,897 | A | 12/1984 | Turner | |
| 4,495,456 | A | 1/1985 | Vercillo et al. | |
| 4,497,478 | A | 2/1985 | Reschenhofer | |
| 4,683,381 | A | 7/1987 | Dufoug | |
| 4,707,704 | A | 11/1987 | Allen | |
| 4,757,949 | A | 7/1988 | Horton | |
| 4,814,632 | A | 3/1989 | Glaeser | |
| 4,815,669 | A | 3/1989 | Fujii | |
| 4,842,205 | A | 6/1989 | Araki | |
| 4,889,291 | A | 12/1989 | Goldhammer et al. | |
| 4,890,797 | A | 1/1990 | Fujii et al. | |
| 4,914,721 | A | 4/1990 | Glaeser | |
| 5,017,972 | A | 5/1991 | Daughton | |
| 5,081,406 | A | 1/1992 | Hughes et al. | |
| 5,139,205 | A | 8/1992 | Gallagher et al. | |
| 5,166,679 | A | 11/1992 | Vranish et al. | |
| 5,167,374 | A | 12/1992 | Strohmeyer | |
| 5,186,398 | A | 2/1993 | Vigneau, Jr. | |
| 5,198,777 | A | 3/1993 | Masuda et al. | |
| 5,342,033 | A | 8/1994 | Iwata | |
| 5,345,138 | A | 9/1994 | Mukaidono et al. | |
| 5,353,468 | A | 10/1994 | Yap | |
| 5,397,890 | A | 3/1995 | Schueler et al. | |
| 5,409,171 | A | 4/1995 | Stangenberg et al. | |
| 5,415,355 | A | 5/1995 | Gollwitzer | |
| 5,429,313 | A | 7/1995 | Schwelling | |
| 5,453,644 | A | 9/1995 | Yap | |
| 5,494,229 | A | 2/1996 | Rokos | |
| 5,539,322 | A | 7/1996 | Zoughi et al. | |
| 5,662,280 | A | 9/1997 | Nishio et al. | |
| 5,743,521 | A | 4/1998 | Munakata et al. | |
| 5,772,129 | A | 6/1998 | Nishio et al. | |
| 5,775,605 | A | 7/1998 | Tsai | |
| 5,823,529 | A | 10/1998 | Mandel | |
| 5,850,342 | A | 12/1998 | Nakamura et al. | |
| 5,871,162 | A | 2/1999 | Rajewski | |
| 5,924,637 | A | 7/1999 | Niederholtmeyer | |
| D412,716 | S | 8/1999 | Kroger | |
| 5,942,975 | A | 8/1999 | Sorensen | |
| D414,198 | S | 9/1999 | Iwata | |
| 5,988,542 | A | 11/1999 | Henreckson et al. | |
| 6,065,696 | A | 5/2000 | Tsai | |
| D426,805 | S | 6/2000 | Iwata | |
| 6,079,645 | A | 6/2000 | Henreckson et al. | |
| 6,116,528 | A | 9/2000 | Schwelling | |
| 6,141,883 | A | 11/2000 | Mitchell et al. | |
| 6,265,682 | B1 | 7/2001 | Lee | |
| 6,376,939 | B1 | 4/2002 | Suzuki et al. | |
| 6,418,004 | B1 | 7/2002 | Mather et al. | |
| 6,550,701 | B1 | 4/2003 | Chang | |
| 6,561,444 | B1 | 5/2003 | Yokomine et al. | |
| 6,601,787 | B1 | 8/2003 | Langenecker | |
| 6,655,943 | B1 | 12/2003 | Peterson | |
| 6,666,959 | B2 | 12/2003 | Uzoh et al. | |
| 6,676,460 | B1 | 1/2004 | Motsenbocker | |
| 6,698,640 | B2 | 3/2004 | Hakozaki | |
| 6,724,324 | B1 | 4/2004 | Lambert | |
| 6,802,465 | B1 | 10/2004 | Norcott et al. | |
| 6,979,813 | B2 | 12/2005 | Avril | |
| 6,983,903 | B2 | 1/2006 | Chang | |
| 6,997,408 | B2 | 2/2006 | Watano | |
| 7,025,293 | B2 | 4/2006 | Matlin et al. | |
| 7,040,559 | B2 | 5/2006 | Matlin | |
| 7,166,561 | B2 | 1/2007 | Allen | |
| 7,210,867 | B1 | 5/2007 | Silverbrook | |
| 7,213,780 | B2 | 5/2007 | Chen | |
| 7,311,276 | B2 | 12/2007 | Matlin et al. | |
| 7,520,452 | B2 | 4/2009 | Watano et al. | |
| 7,624,938 | B2 * | 12/2009 | Aries et al. | 241/36 |
| 7,631,822 | B2 | 12/2009 | Matlin et al. | |
| 7,631,823 | B2 | 12/2009 | Matlin et al. | |
| 7,631,824 | B2 | 12/2009 | Matlin et al. | |
| 7,635,102 | B2 | 12/2009 | Matlin et al. | |
| 7,661,614 | B2 | 2/2010 | Matlin et al. | |
| 7,663,769 | B2 | 2/2010 | Hayashihara et al. | |
| 7,712,689 | B2 | 5/2010 | Matlin et al. | |
| 2003/0016365 | A1 | 1/2003 | Liess et al. | |
| 2003/0042342 | A1 | 3/2003 | Kroger et al. | |
| 2004/0008122 | A1 | 1/2004 | Michael | |
| 2004/0069883 | A1 | 4/2004 | Watanabe et al. | |
| 2004/0159198 | A1 | 8/2004 | Peot et al. | |
| 2004/0194594 | A1 | 10/2004 | Dils et al. | |
| 2004/0226800 | A1 | 11/2004 | Pierga | |
| 2005/0046651 | A1 | 3/2005 | Askren et al. | |
| 2005/0150986 | A1 | 7/2005 | Castronovo | |
| 2005/0213106 | A1 | 9/2005 | Weijers et al. | |
| 2006/0016919 | A1 | 1/2006 | Castronovo | |
| 2006/0054725 | A1 | 3/2006 | Matlin | |
| 2006/0091247 | A1 | 5/2006 | Matlin | |
| 2006/0243631 | A1 | 11/2006 | Duke | |
| 2007/0007373 | A1 | 1/2007 | Matlin | |
| 2007/0025239 | A1 | 2/2007 | Jain et al. | |
| 2007/0063082 | A1 | 3/2007 | Coleman | |
| 2007/0080252 | A1 | 4/2007 | Pierce | |
| 2007/0087942 | A1 | 4/2007 | Allen | |
| 2007/0164135 | A1 | 7/2007 | Zhong | |
| 2007/0164138 | A1 | 7/2007 | Allen | |
| 2007/0215728 | A1 | 9/2007 | Priester | |
| 2007/0221767 | A1 | 9/2007 | Matlin et al. | |
| 2007/0246582 | A1 * | 10/2007 | Aries et al. | 241/36 |
| 2008/0093487 | A1 | 4/2008 | Lee | |
| 2008/0231261 | A1 | 9/2008 | Dengler et al. | |
| 2009/0025239 | A1 * | 1/2009 | Pan | 33/501.02 |
| 2009/0032629 | A1 | 2/2009 | Aries et al. | |
| 2009/0090797 | A1 | 4/2009 | Matlin et al. | |
| 2010/0051731 | A1 | 3/2010 | Matlin et al. | |
| 2010/0084496 | A1 | 4/2010 | Matlin et al. | |
| 2010/0102153 | A1 | 4/2010 | Matlin et al. | |
| 2010/0134805 | A1 | 6/2010 | Pan | |
| 2010/0170967 | A1 | 7/2010 | Jensen et al. | |
| 2010/0170969 | A1 | 7/2010 | Jensen et al. | |
| 2010/0176227 | A1 | 7/2010 | Davis et al. | |
| 2010/0181398 | A1 | 7/2010 | Davis et al. | |
| 2010/0213296 | A1 | 8/2010 | Sued et al. | |
| 2010/0213297 | A1 | 8/2010 | Sued et al. | |
| 2010/0213300 | A1 | 8/2010 | Matlin et al. | |
| 2010/0243774 | A1 | 9/2010 | Hu et al. | |
| 2010/0252661 | A1 | 10/2010 | Matlin et al. | |
| 2010/0252664 | A1 | 10/2010 | Matlin et al. | |
| 2010/0270404 | A1 | 10/2010 | Chen | |
| 2010/0282879 | A1 * | 11/2010 | Chen | 241/36 |
| 2010/0288861 | A1 | 11/2010 | Cai et al. | |
| 2010/0320299 | A1 | 12/2010 | Matlin et al. | |
| 2011/0210194 | A1 | 9/2011 | Davis et al. | |
| 2011/0272504 | A1 | 11/2011 | Matlin et al. | |
| 2011/0272505 | A1 | 11/2011 | Matlin et al. | |
| 2011/0280642 | A1 | 11/2011 | Ikeda et al. | |
| 2011/0297769 | A1 | 12/2011 | Matlin et al. | |
| 2011/0297770 | A1 | 12/2011 | Matlin et al. | |

FOREIGN PATENT DOCUMENTS

| | | |
|---|---|---|
| DE | 4121330 | 1/1993 |
| DE | 4207292 | 1/1993 |
| DE | 4237861 | 5/1994 |
| DE | 4437348 | 4/1996 |
| DE | 19835093 | 2/1999 |
| DE | 202004000907 | 5/2005 |
| DE | 102006036136 | 1/2008 |
| DE | 202010001577 U1 | 11/2010 |
| EP | 268244 | 11/1987 |
| EP | 0392867 | 10/1990 |
| EP | 562076 | 9/1992 |
| EP | 524708 | 1/1997 |
| EP | 0792691 | 9/1997 |
| EP | 0818241 | 1/1998 |
| EP | 856945 | 1/1998 |
| EP | 855221 | 7/1998 |
| EP | 1177832 | 2/2002 |
| EP | 1195202 | 4/2002 |
| EP | 2180290 | 7/2008 |
| EP | 2022566 | 2/2009 |
| GB | 1199903 | 7/1970 |

| | | | |
|---|---|---|---|
| GB | 2171029 | | 8/1986 |
| GB | 2209963 | | 6/1989 |
| GB | 2440651 | | 2/2008 |
| GB | 2442942 | | 4/2008 |
| GB | 2451513 | | 2/2009 |
| JP | 52-11691 | | 1/1977 |
| JP | 5311911 | | 3/1978 |
| JP | 57-76734 | | 1/1982 |
| JP | 57-070445 | | 4/1982 |
| JP | 57-070445 | U | 4/1982 |
| JP | 58-223448 | | 12/1983 |
| JP | 59150554 | | 8/1984 |
| JP | 61-000702 | | 1/1986 |
| JP | 62183555 | | 11/1987 |
| JP | 63-173342 | | 11/1988 |
| JP | 2-277560 | | 11/1990 |
| JP | H2-303550 | | 12/1990 |
| JP | 04-157093 | | 5/1992 |
| JP | 04-0180852 | | 6/1992 |
| JP | 5-96198 | | 4/1993 |
| JP | H05-092144 | | 4/1993 |
| JP | 6-277548 | | 10/1994 |
| JP | 7-299377 | | 11/1995 |
| JP | 8-108088 | | 4/1996 |
| JP | 8-131861 | | 5/1996 |
| JP | 08-131962 | | 5/1996 |
| JP | 08-164343 | | 6/1996 |
| JP | 9-38513 | | 2/1997 |
| JP | 09075763 | | 3/1997 |
| JP | 09-150069 | | 10/1997 |
| JP | 9-262491 | | 10/1997 |
| JP | 10-048344 | | 2/1998 |
| JP | 11-216383 | | 8/1999 |
| JP | 11-304942 | | 11/1999 |
| JP | 2000346288 | | 12/2000 |
| JP | 2002-239405 | | 8/2002 |
| JP | 2002239405 | | 8/2002 |
| JP | 2004-321840 | | 11/2004 |
| JP | 2004321993 | | 11/2004 |
| WO | 2005070553 | | 8/2005 |
| WO | 2006019985 | | 2/2006 |
| WO | 2006036370 | | 4/2006 |
| WO | 2007109753 | | 9/2007 |
| WO | 2007122364 | | 11/2007 |
| WO | 2007137761 | | 12/2007 |

OTHER PUBLICATIONS

Notification of Transmittal of International Search Report, Search Report and Written Opinion of the International Searching Authority for PCT/2010/038993, mailed Feb. 22, 20011.

Invitation to Pay Additional Fees with Partial International Search Report for PCT International Patent Application No. PCT/US2010/038993, mailed Dec. 6, 2010.

Complaint for Declaratory Judgment filed on Nov. 15, 2010 by Royal Applicance Manufacturing Co., d/b/a/ TTI Floor Care North America and Techtronic Industries Co. Ltd. against Fellowes, Inc.

Acco Rexel, Mainstream 1050/2150/2250/3150/3250 and 3350, 115V Machines Illustrated Parts Lists and Services Instructions, Mar. 25, 2002, Issue No. 4.

Acco Rexel, Deckside and Office 115V Machines Illustrated Parts Lists and Service Instructions, Aug. 18, 1999.

Acco Rexel, Deckside and Office 230V Machines Illustrated Parts Lists and Service Instructions, Aug. 1, 2000.

English Translation of Japanese Patent Application Publication No. 9-38513, published on Feb. 10, 1997.

U.S. Appl. No. 60/613,750, filed Sep. 27, 2004, Pierce.

U.S. Appl. No. 60/686,490, filed May 31, 2005, Pierce.

U.S. Appl. No. 60/688,285, filed Jun. 7, 2005, Pierce.

TI's Digital Signal Controllers Put Brake on SawStop Table Saw, Feb. 9, 2005, pp. 1-3. (printed from www.embeddedstar.com/press/content/2005/2/embedded17827.html).

GBC Shredmaster Service Manual, Part #6001054, referencing Models 2230S and 2250X Paper Shredders, Nov. 1997.

The Stationary and Business Machines—Japan, "DS-4000 by Carl Jimuki K.K.", Jun. 2003.

The Stationary and Business Machines—Japan, "NSE-501CN by Nakabayashi K.K.", Oct. 2004.

SEM Advertisement for "LK-3 Automatic Oiling System," printed on Mar. 14, 2006, 3 pages.

Advertisement for Auto-Lube, Automatic Oiler for Paper Shredders, printed on Mar. 14, 2006, 1 page.

Advertisement for DAHLE Automatic Oiler/Paper Shredder Oiling Accessory, "1st Paper Shredder," printed on Mar. 17, 2006, 2 pages.

Instructions for Installing a Shredder Oiling System from www.compax.com, printed on Mar. 17, 2006, 3 pages.

* cited by examiner

RESTRICTIVE THROAT MECHANISM FOR PAPER SHREDDERS

RELATED APPLICATION(S)

This application is a continuation-in-part of U.S. patent application Ser. No. 12/487,220, filed Jun. 18, 2009, which is incorporated herein by reference in its entirety, and claims priority thereto.

BACKGROUND OF THE INVENTION

1. Field of the Invention

The present invention relates to shredders for destroying articles, such as documents, compact discs, etc.

2. Description of Related Art

Shredders are well known devices for destroying articles, such as paper, documents, compact discs ("CDs"), expired credit cards, etc. Typically, users purchase shredders to destroy sensitive information bearing articles, such as credit card statements with account information, documents containing company trade secrets, etc.

A common type of shredder has a shredder mechanism contained within a housing that is removably mounted atop a container. The shredder mechanism typically has a series of cutter elements that shred articles fed therein and discharge the shredded articles downwardly into the container.

A common frustration of users of shredders is to feed too many papers into the feed throat, only to have the shredder jam after it has started to shred the papers. The present invention endeavors to provide a shredder with a mechanism that prevents too many sheets of paper from being fed into the throat. In particular, the present invention uses a thickness detector and a blocking mechanism configured to block the throat responsive to sensing insertion into the throat of articles having a thickness above a predetermined thickness threshold.

BRIEF SUMMARY OF THE INVENTION

One aspect provides a shredder including a housing having a throat for receiving at least one article to be shredded and a shredder mechanism received in the housing. The shredder also includes an electrically powered motor and cutter elements. The shredder mechanism enables the at least one article to be shredded to be fed into the cutter elements and the motor is operable to drive the cutter elements so that the cutter elements shred the at least one article fed therein. A thickness detector comprises a contact member extending into the throat and a blocking member. The shredder also includes an actuator for moving the blocking member between a retracted position and an extended position. The actuator and the thickness detector are coupled to enable the actuator to move the blocking member from the retracted position to the extended position responsive to the movement of the contact member by insertion into the throat of the at least one article above a predetermined maximum thickness threshold. The blocking member is configured such that in the extended position the blocking member prevents further insertion of the at least one article into the throat, and in the retracted position the blocking member permits further insertion thereof into the throat.

Another aspect provides a shredder having a housing having a throat for receiving at least one article to be shredded and a shredder mechanism received in the housing. The shredder mechanism includes an electrically powered motor and cutter elements and enables the at least one article to be shredded to be fed into the cutter elements. The motor is operable to drive the cutter elements so that the cutter elements shred the at least one article fed therein. The shredder also includes a cam mechanism provided in the throat and the cam mechanism is biased to a disengaged position and movable to an engaged position responsive to insertion into the throat of the at least one article above a predetermined maximum thickness threshold by engagement of the at least one article. The cam mechanism is configured such that in the engaged position the cam mechanism engages the at least one article to prevent further insertion thereof into the throat, and in the disengaged position the cam mechanism is disengaged from the at least one article to permit further insertion thereof into the throat. The cam mechanism comprises a relief mechanism operative to prevent the cam mechanism from being moved further into the throat when in the engaged position.

Another aspect provides a method for operating a shredder that includes a housing having a throat for receiving at least one article to be shredded, a thickness detector comprising a contact member extending into the throat, and a blocking member moveable between a retracted position and an extended position. A shredder mechanism is received in the housing and includes an electrically powered motor and cutter elements. The shredder mechanism enables the at least one article to be shredded to be fed into the cutter elements and the motor is operable to drive the cutter elements in a shredding direction so that the cutter elements shred the articles fed therein. The method includes actuating the blocking member by an actuator coupled to the thickness detector to move the blocking member from the retracted position to the extended position responsive to the movement of the contact member by insertion into the throat of the at least one article above a predetermined maximum thickness threshold. The method further includes blocking the throat by the blocking member, in the extended position, to prevent further insertion of the at least one article into the throat.

Other aspects, features, and advantages of the present invention will become apparent from the following detailed description, the accompanying drawings, and the appended claims.

DETAILED DESCRIPTION OF THE INVENTION

The following embodiments are described with reference to the drawings and are not to be limiting in their scope in any manner.

Figure 1:
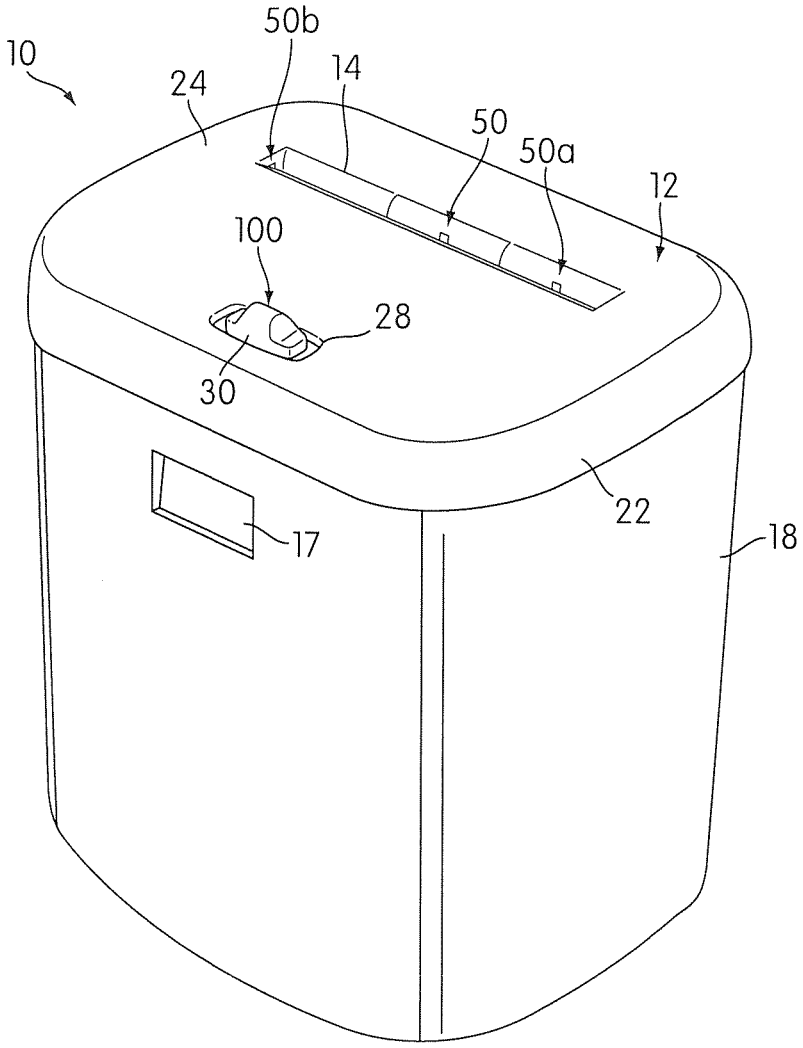
FIG. 1 is an perspective view of a shredder constructed in accordance with an embodiment of the present invention.

FIG. 1 is a top perspective view of a shredder apparatus 10 constructed in accordance with an embodiment of the present invention. The shredder 10 is designed to destroy or shred articles such as paper, paper products, CDs, DVDs, credit cards, and other objects. In an embodiment, the shredder 10 may comprise rollers (not shown) to assist in moving the shredder 10. The shredder 10 comprises a shredder housing 12 that sits on top of a container 18, for example.

The shredder housing 12 comprises at least one input opening 14 on an upper side 24 (or upper wall or top side or top wall) of the housing 12 for receiving materials to be shredded. The input opening 14 extends in a lateral direction, and is also often referred to as a throat. The input opening or throat 14 may extend generally parallel to and above a shredder mechanism 20 (described below). The input opening or throat 14 may be relatively narrow, so as to prevent overly thick items, such as large stacks of documents, from being fed into therein. However, the throat 14 may have any configuration. The throat 14 may have a first side 38 (see FIG. 4*a*) that is spaced apart from a second side 40 (see FIG. 4*a*), wherein the distance between the first side 38 and the second side 40 defines the thickness of the throat 14. In one embodiment, an additional or second input opening (not shown) may be provided in shredder housing 12. For example, input opening 14 may be provided to receive paper, paper products, and other items, while second input opening (not shown) may be provided to receive objects such as CDs and DVDs.

Figure 2:
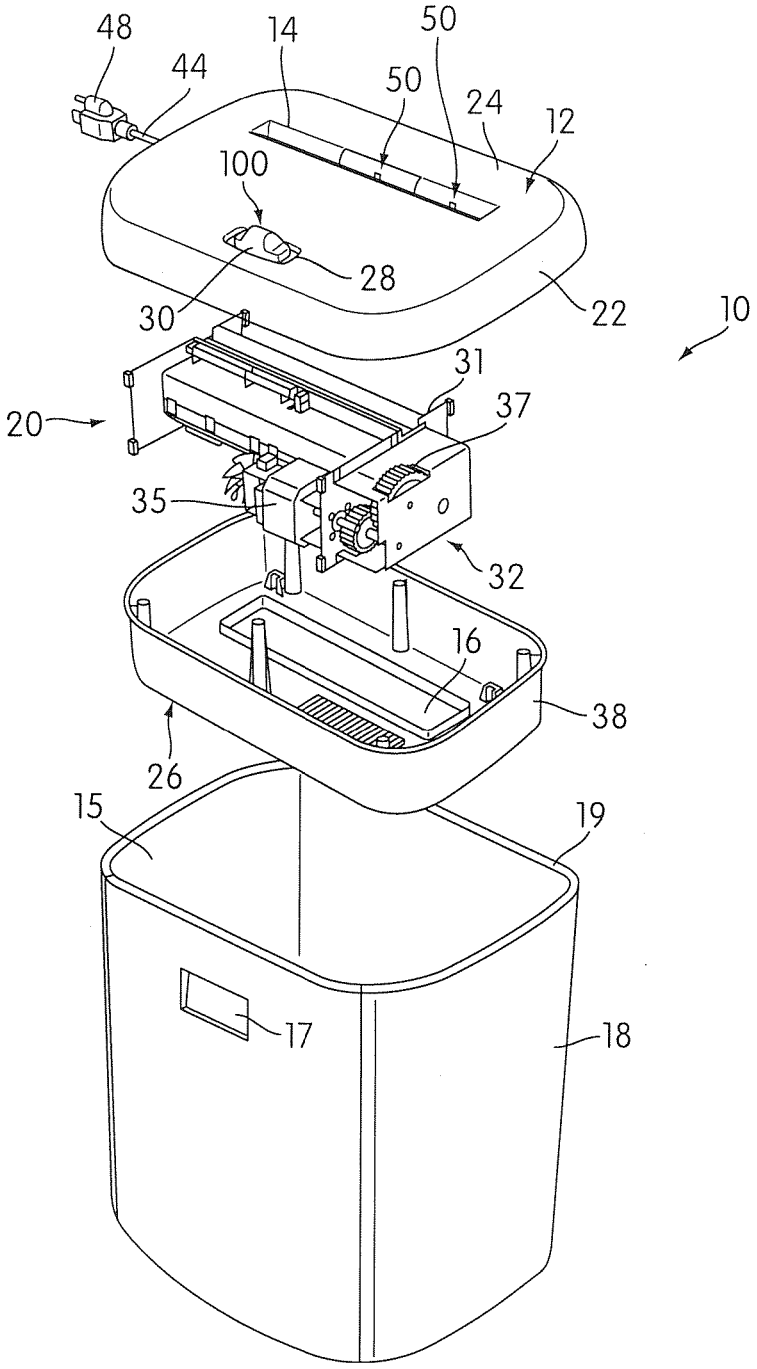
FIG. 2 is an exploded perspective view of a shredder constructed in accordance with an embodiment of the present invention.

Shredder housing 12 also comprises an output opening 16 on a lower side 26 (or bottom side or bottom wall or underside or bin side), such as shown in FIG. 2. In an embodiment, shredder housing 12 may include a bottom receptacle 38 with lower side 26 to receive shredder mechanism 20 therein. Bottom receptacle 38 is affixed to the underside of the upper side 24 or top wall base using fasteners, for example. The receptacle 38 has output opening 16 in its bottom side 26 or bottom wall through which shredded particles are discharged.

Generally speaking, the shredder 10 may have any suitable construction or configuration and the illustrated embodiments provided herein are not intended to be limiting in any way. In addition, the term "shredder" or "shredder apparatus," used interchangeably throughout this specification, are not intended to be limited to devices that literally "shred" documents and articles, but instead intended to cover any device that destroys documents and articles in a manner that leaves such documents and articles illegible and/or useless.

Figure 3:
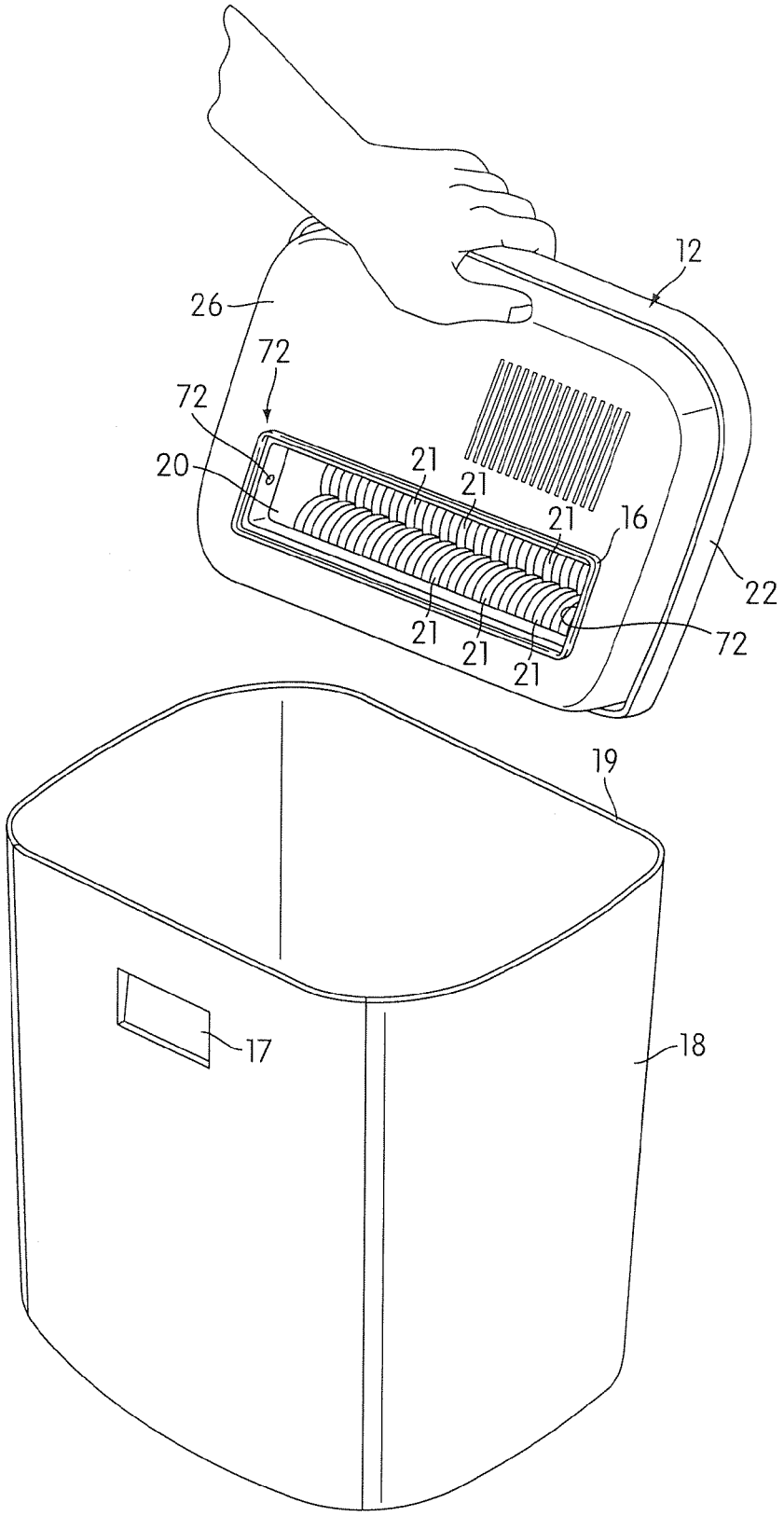
FIG. 3 is an detailed perspective view of a lower side of a shredder housing of a shredder apparatus in accordance with an embodiment of the present invention.

As noted, the shredder 10 also comprises a shredder mechanism 20 (shown generally in FIG. 2) in the shredder housing 12. When articles are inserted into the at least one input opening or throat 14, they are directed toward and into shredder mechanism 20. "Shredder mechanism" is a generic structural term to denote a device that destroys articles using at least one cutter element. Destroying may be done in any particular way. Shredder mechanism 20 includes a drive system 32 (generally shown in FIG. 2) with at least one motor 35, such as an electrically powered motor, and a plurality of cutter elements 21 (see FIG. 3). The cutter elements 21 are mounted on a pair of parallel mounting shafts (not shown). The motor 35 operates using electrical power to rotatably drive first and second rotatable shafts of the shredder mechanism 20 and their corresponding cutter elements 21 through a conventional transmission 37 so that the cutter elements 21 shred or destroy materials or articles fed therein, and, subsequently, deposit the shredded materials into opening 15 of container 18 via the output opening 16. The shredder mechanism 20 may also include a sub-frame 31 for mounting the shafts, motor, and transmission in the housing 12, for example. The drive system may have any number of motors and may include one or more transmissions. Also, the plurality of cutter elements 21 are mounted on the first and second rotatable shafts in any suitable manner. For example, in an embodiment, the cutter elements 21 are rotated in an interleaving relationship for shredding paper sheets and other articles fed therein. In an embodiment, the cutter elements 21 may be provided in a stacked relationship. The operation and construction of such a shredder mechanism 20 is well known and need not be discussed herein in detail. As such, the at least one input opening or throat 14 is configured to receive materials inserted therein to feed such materials through the shredder mechanism 20 and to deposit or eject the shredded materials through output opening 16.

Figure 15:
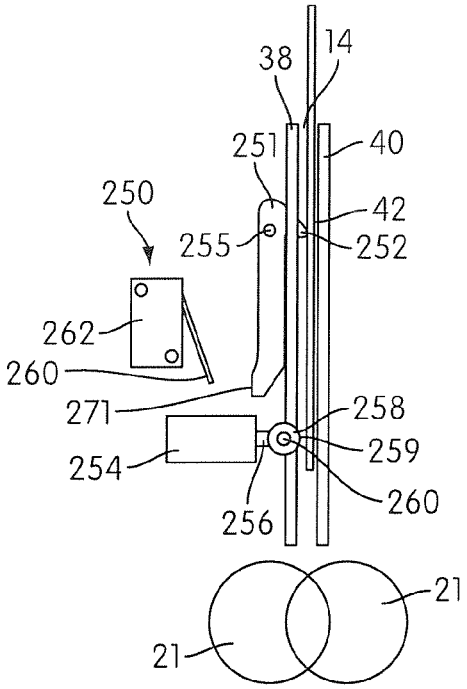
FIG. 15 is a detailed view of a thickness detector and a blocking member in accordance with an embodiment of the present invention.

The shredder 10 may include a thickness detector 250 provided near the throat 14. In one embodiment, the thickness detector 250 includes a lever or movable member 251 and a switch 262, as shown in FIG. 15. The movable member 251 includes a contact member or portion 252 extending into the throat 14 (see FIG. 16). One or more of the thickness detectors 250 may be provided in/near the throat 14. One or more blocking members 256 (see FIG. 15) may also be provided in/near the throat. The thickness detector 250 is configured to actuate the blocking member 256 to move from a retracted position to an extended position responsive to insertion into the throat of the at least one article above a predetermined maximum thickness threshold. The blocking member 256 is configured such that in the extended position the blocking member 256 prevents further insertion of the articles into the throat, and in the retracted position the blocking member 256 permits further insertion of the articles into the throat. The thickness detector 250 and the blocking member 256 will be described in detail later.

Alternatively or additionally, the shredder 10 may include a cam mechanism 23 (see FIGS. 4*a* and 4*b*) provided in the throat 14. One or more of the cam mechanisms 23 may be spaced apart along the throat 14. The cam mechanism 23 may be biased to a disengaged position and movable to an engaged position responsive to insertion into the throat 14 of the at least one article above a predetermined maximum thickness threshold. The cam mechanism 23 may be configured such that in the engaged position the cam mechanism 23 engages the at least one article to prevent further insertion thereof into the throat 14, and in the disengaged position the cam mechanism 23 is disengaged from the at least one article to permit further insertion thereof into the throat 14. In some embodiments, the cam mechanism 23 may be considered to provide the functions of both the thickness detector 250 and the blocking member 256. It is contemplated that the cam mechanisms 23 need not be constructed and arranged to actuate other devices, although it may be used as such. That is, the term "cam mechanism" does not necessarily refer to a mechanism used to actuate other devices or effect the actuation of other devices. For example, "cam mechanism" may refer to a mechanism that contacts a surface of another object, such as the articles inserted into the throat 14, to engage the articles to prevent further insertion thereof into the throat 14. Therefore, "cam mechanism" as used herein is not limited to any mechanisms having a specific motion or movement and may generally refer to a mechanism configured to contact the surface of the articles (e.g., a contact member). Accordingly, the cam mechanisms 23 may either engage the articles against the throat 14 on their own or may actuate another device to engage the articles against the throat 14. The cam mechanism 23 will be described in detail later.

Shredder housing 12 may be configured to be seated above or upon the container 18. As shown in FIG. 2, shredder housing 12 may comprise a detachable paper shredder mechanism. That is, in an embodiment, the shredder housing 12 may be removed in relation to the container 18 to ease or assist in emptying the container 18 of shredded materials. In an embodiment, shredder housing 12 comprises a lip 22 or other structural arrangement that corresponds in size and shape with a top edge 19 of the container 18. The container 18 receives paper or articles that are shredded by the shredder 10 within its opening 15. More specifically, after inserting materials into input opening 14 for shredding by cutter elements 21, the shredded materials or articles are deposited from the output opening 16 on the lower side 26 of the shredder housing 12 into the opening 15 of container 18. The container 18 may be a waste bin, for example.

In an embodiment, the container 18 may be positioned in a frame beneath the shredder housing 12. For example, the frame may be used to support the shredder housing 12 as well as comprise a container receiving space so that the container 18 may be removed therefrom. For example, in an embodiment, a container 18 may be provided to slide like a drawer with respect to a frame, be hingedly mounted to a frame, or comprise a step or pedal device to assist in pulling or removing it therefrom. Container 18 may comprise an opening, handle, or recess 17 to facilitate a user's ability to grasp the bin (or grasp an area approximate to recess 17), and thus provide an area for the user to easily grasp to separate the container 18 from the shredder housing 12, thereby providing access to shredded materials. The container 18 may be substantially or entirely removed from being in an operative condition with shredder housing 12 in order to empty shredded materials such as chips or strips (i.e., waste or trash) located therein. In an embodiment, the container or bin 18 may comprise one or more access openings (not shown) to allow for the deposit of articles therein.

Generally the terms "container," "waste bin," and "bin" are defined as devices for receiving shredded materials discharged from the output opening 16 of the shredder mechanism 20, and such terms are used interchangeably throughout this specification. However, such terms should not be limiting. Container 18 may have any suitable construction or configuration.

Typically, the power supply to the shredder 10 will be a standard power cord 44 with a plug 48 on its end that plugs into a standard AC outlet. Also, a control panel may be provided for use with the shredder 10. Generally, the use of a control panel is known in the art. As shown in FIG. 1, a power switch 100 or a plurality of switches may be provided to control operation of the shredder 10. The power switch 100 may be provided on the upper side 24 of the shredder housing 12, for example, or anywhere else on the shredder 10. The upper side 24 may have a switch recess 28 with an opening therethrough. An on/off switch 100 includes a switch module (not shown) mounted to housing 12 underneath the recess 28 by fastening devices, and a manually engageable portion 30 that moves laterally within recess 28. The switch module has a movable element (not shown) that connects to the manually engageable portion 30 to move the switch module between its states. Movement of the manually engageable portion of switch 100 moves the switch module between states. In the illustrated embodiment shown in FIG. 2, the switch module connects the motor 35 to the power supply. This connection may be direct or indirect, such as a connection via a controller 23.

The term "controller" may be used to refer to any device that controls operation of a component of the shredder 10. For example, a controller may be a device or microcontroller having a central processing unit (CPU) and input/output devices that are used to monitor parameters from devices that are operatively coupled to the controller. The input/output devices also permit the CPU to communicate and control the devices (e.g., such as a sensor or the motor 35) that are operatively coupled to the controller. As is generally known in the art, the controller may optionally include any number of storage media such as memory or storage for monitoring or controlling the sensors coupled to the controller. In some embodiments, a controller may be a conventional circuit with no processor, and may comprise one or more binary switches or a relays. The controller may optionally comprise a processor. In some embodiments, the controller may be circuitry configured to activate or operate components of the shredder 10 in accordance with logic, rules, and/or software.

Figure 20:
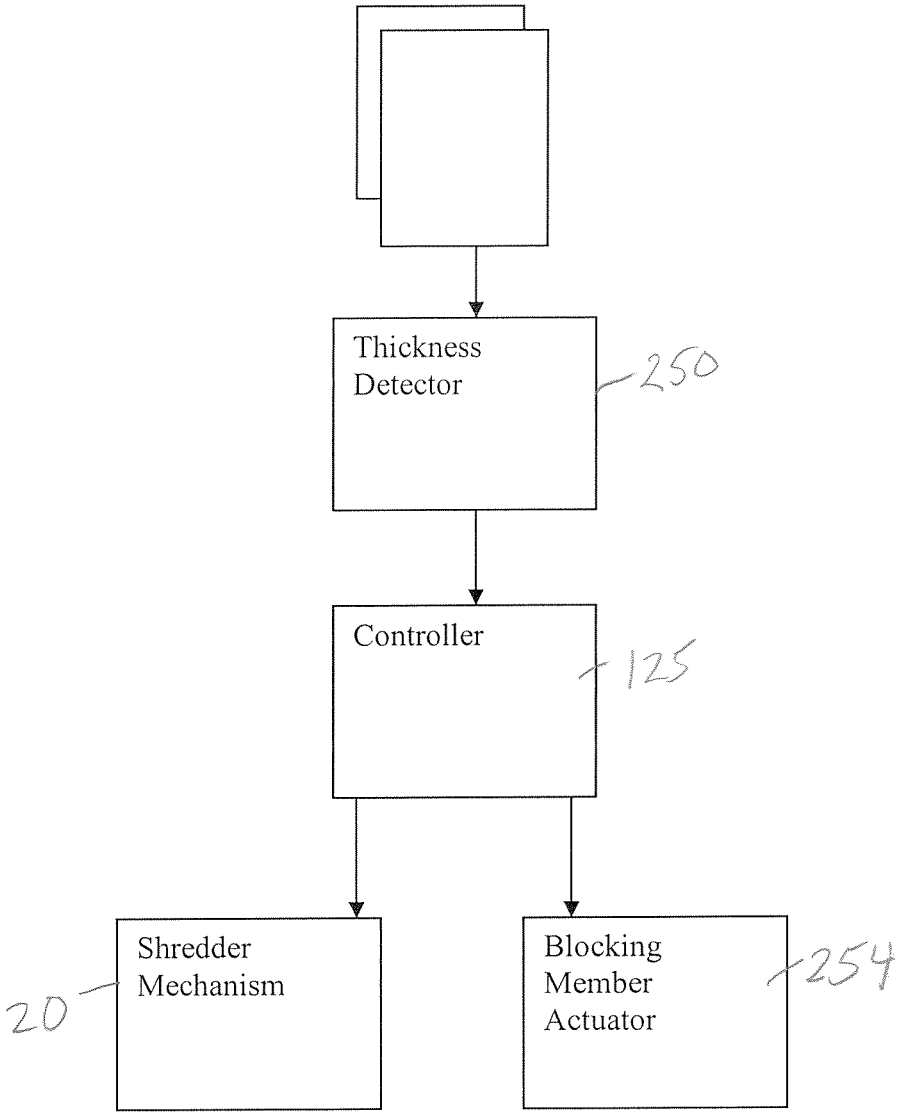
FIG. 20 is a schematic illustration of interaction between a controller and other parts of the shredder.

The controller 23 (see FIG. 20) may communicate with the motor 35 of the shredder mechanism 20. When the switch 100 is moved to an on position, the controller 23 can send an electrical signal to the drive of the motor 35 so that it rotates the cutting elements 21 of the shredder mechanism 20 in a shredding direction, thus enabling paper sheets to be fed in the throat 14 to be shredded. Additionally or alternatively, when the switch 100 is in an on position, the switch 100 may be set to an idle or ready position, which communicates with the control panel. The idle or ready position may correspond to selectively activating the shredder mechanism 20, for example. The controller 23 may selectively enable the operation of the shredder mechanism 20 based on the detection of the presence or insertion of at least one article (e.g., paper) in the throat 14 by a sensor (not shown), such as an activation sensor. The switch 100 may also be moved to an off position, which causes the controller 23 to stop operation of the motor 35.

The switch module contains appropriate contacts for signaling the position of the switch's manually engageable portion. As an option, the switch 100 may also have a reverse position that signals the controller 23 to operate the motor 35 in a reverse manner. This would be done by using a reversible motor and applying a current that is of reverse polarity relative to the on position. The capability to operate the motor 35 in a reversing manner is desirable to move the cutter elements 21 in a reversing direction for clearing jams, for example. To provide each of the noted positions, the switch 100 may be a sliding switch, a rotary switch, or a rocker switch. Also, the switch 100 may be of the push switch type that is simply depressed to cycle the controller 23 through a plurality of conditions.

Generally, the construction and operation of the switch 100 and controller 23 for controlling the motor are well known and any construction for these may be used. For example, a touch screen switch, membrane switch, or toggle switches are other examples of switches that may be used. Also, the switch need not have distinct positions corresponding to on/off/idle/reverse, and these conditions may be states selected in the controller 23 by the operation of the switch. Any of the conditions could also be signaled by lights, on a display screen, or otherwise.

In some embodiments, the shredder 10 may have activation sensors that are activated when the sensors detect articles that are inserted into the throat 14. When the switch is in its on (or idle) position, the controller 23 may be configured to operate the motor 35 to drive the cutter elements 21 of the shredder mechanism 20 in the shredding direction when the sensors detect the presence or insertion of the articles to be shredded. Having the sensors activate the shredder 10 is desirable because it allows the user to ready the shredder 10 by moving the switch to its on position, but the controller will not operate the shredder mechanism 20 to commence shredding until the sensors detect the presence or insertion of one or more articles in the throat 14. Once the articles have passed into the shredder mechanism 20 beyond the sensors, the controller 23 will then stop the movement or rotation of the cutter elements 21 of shredding mechanism 20, as that corresponds to the articles having been fully fed and shredded. Typically, a slight delay in time, such as 3-5 seconds, is used before stopping the shredder mechanism 20 to ensure that the articles have been completely shredded by the cutter elements 21 and discharged from the shredder mechanism 20. The use of such sensors to activate the shredder mechanism 20 is beneficial because it allows the user to perform multiple shredding tasks without having the shredder mechanism 20 operating, making noise, between tasks. It also reduces wear on the shredder mechanism 20, as it will only operate when substrates are fed therein, and will not continually operate. In some embodiments, the thickness detector 250 may operate as an activation sensor. In such embodiments, the thickness detector 250 may be able to detect insertion of articles below the predetermined threshold.

The use of cam mechanisms 23 or thickness detectors 250 and blocking members 256 to prevent further insertion into the throat 14 of articles above a predetermined thickness threshold may also help reduce wear on the shredder mechanism 20, as jamming of the shredder increases the strain on the shredder mechanism 20. The aforementioned predetermined thicknesses may be determined as follows. First, because the actual maximum thickness that the shredder mechanism 20 may handle will depend on the material that makes up the item to be shredded, the maximum thickness may correspond to the thickness of the toughest article expected to be inserted into the shredder, such as a compact disc, which is made from polycarbonate. If it is known that the shredder mechanism 20 may only be able to handle one compact disc at a time, the predetermined maximum thickness may be set to the standard thickness of a compact disc (i.e., 1.2 mm). It is estimated that such a thickness would also correspond to about 12 sheets of 20 lb. paper. Second, a margin for error may also be factored in. For example, the predetermined maximum thickness may be set to a higher thickness, such as to 1.5 mm, which would allow for approximately an additional 3 sheets of paper to be safely inserted into the shredder 10 (but not an additional compact disc). Of course, these examples are not intended to be limiting in any way.

For shredders that include separate throats for receiving sheets of paper and compact discs and/or credit cards, a cam mechanism 23 or thickness detector 250 and blocking member 256 may be provided in each of the throats and configured for different predetermined maximum thicknesses. For example, the same shredder mechanism 20 may be able to handle one compact disc and 18 sheets of 20 lb. paper. Accordingly, the predetermined maximum thickness associated with the thickness detector 250 associated with the throat 14 that is specifically designed to receive compact discs may be set to about 1.5 mm (0.3 mm above the standard thickness of a compact disc), while the predetermined maximum thickness associated with the cam mechanism 23 or thickness detector 250 associated with the throat 14 that is specifically designed to receive sheets of paper may be set to about 1.8 mm. In some embodiments, the predetermined thickness threshold may also be adjusted based upon an input, such as for example, a selector switch for inputting the material as described in U.S. patent Ser. No. 11/444,491, which is hereby incorporated by reference in its entirety. In some embodiments, the predetermined thickness threshold may also be based on motor feedback as described in U.S. patent Ser. No. 11/867,260, which is hereby incorporated by reference in its entirety. Of course, these examples are not intended to be limiting in any way and are only given to illustrate features of embodiments of the invention.

Figure 4A:
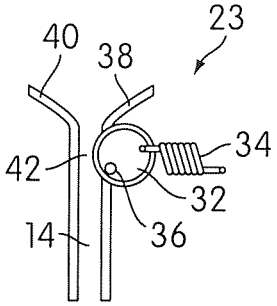
FIGS. 4*a*-4*b* are detailed views of a cam mechanism in accordance with a first embodiment of the present invention.

FIG. 4*a* shows the cam mechanism 23 in accordance with one embodiment of the invention. In this embodiment, the cam mechanism 23 includes a cam member 32 and a spring 34, wherein the spring 34 is operatively connected to the cam member 32 and to a portion of the shredder 10. In this embodiment, the second side 40 of the throat 14 and the cam member 32 are spaced apart to define a gap 42 through which articles may pass when the cam mechanism 23 is in the disengaged position. The gap 42 may be smaller than the thickness of the throat 14. As shown, the cam member 32 is configured to rotate around a pivot point 36 that may be provided near the outer circumference of the cam member 32 and in proximity to the first side 38 of the throat 14. That is, the pivot point 36 is eccentric to the cam wheel 34. As such, the cam member 32 is constructed and arranged to rotate closer in proximity towards the second side 40 of the throat 14 when the cam member 32 is rotated in a counterclockwise direction around the pivot point 36. The cam member 32 may be attached to a portion of the shredder at the pivot point 36 using an attachment mechanism, such as a pin, fastener, or other attachment mechanisms known in the art. It is contemplated that in other embodiments, the location of the pivot point 36 may vary.

Figure 4B:
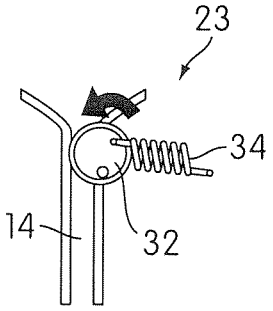

In some embodiments, the cam mechanism 23 is movable between the disengaged position (as shown in FIG. 4*a*) wherein the cam mechanism 23 permits further insertion of articles into the throat 14 and the engaged position (as shown in FIG. 4*b*) wherein the cam mechanism 23 prevents further insertion of articles into the throat 14. As shown in FIG. 4*a*, the spring 34 generally biases the cam mechanism 23 to the disengaged position until articles having a thickness above the predetermined thickness threshold are inserted into the throat 14. The cam mechanism 23 may be configured such that friction between the cam member 32 and the articles above the predetermined thickness threshold being inserted into the throat 14 may rotate the cam member 32 in a counterclockwise direction around the pivot point 36 to the engaged position. This results from the gap 42 being set equal to the predetermined thickness when the cam member 32 is in the disengaged position. As such, articles less than or equal to the predetermined thickness can pass through the gap 42, but articles greater than the predetermined thickness will frictionally engage the cam member 32 and move it to the engaged position. The spring 34 may be constructed and arranged to extend as the cam member 32 is rotated towards the second side 40 of the throat 14 to the engaged position. In the embodiment shown in FIG. 4*b*, when the cam mechanism 23 is in the engaged position, the cam member 32 engages the articles and the size of the gap 42 is reduced so that the articles cannot be further inserted into the throat 14.

In other words, the cam member 32 binds the articles against the second side 40 of the throat 14 in the engaged position. Because of the frictional engagement, further force attempting to insert the articles will cause further movement of the cam member 32 in the engaging direction, thus increasing the binding effect.

The term disengaged is used herein in the functional sense, meaning that the cam member 32 is in the position where it is not actively interfering with the insertion of the article(s). It is possible for there to be incidental contact between the articles and the cam member 32 in the disengaged position, as paper rarely travels perfectly straight, but the engagement is not frictionally sufficient to cause movement of the cam member 32 to the engaged position. Likewise, the term engaged is used herein similarly in the functional sense to mean that the cam member 32 is engaged with the articles by the friction therebetween to prevent their further insertion. Mere incidental contact between the cam member 32 and the article(s) does not establish the engaged position. These terms could also be referred to as frictionally disengaged and frictionally engaged in that sense.

Figure 5A:
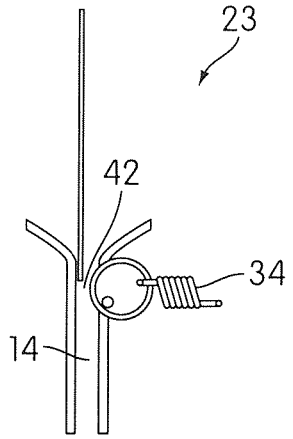
FIGS. 5*a*-5*b* are detailed views of the operation of the cam mechanism shown in FIGS. 4*a*-4*b;*
Figure 5B:
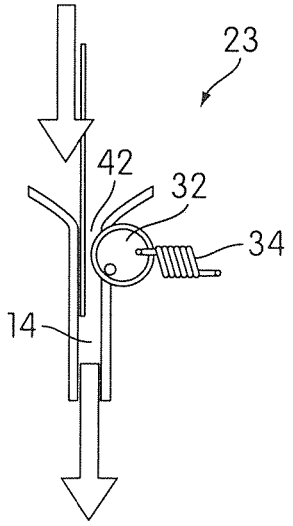

FIG. 5*a* shows the cam mechanism 23 in the disengaged position before articles having a thickness equal to or below the predetermined thickness threshold are inserted into the throat 14. In this embodiment, the articles must be inserted past the gap 42 to be further inserted into the throat 14. If the thickness of the articles is less than or equal to the predetermined thickness threshold, the articles may be inserted past the gap 42 to be further inserted into the throat 14 without actuating the cam mechanism 23 to the engaged position. It is contemplated that articles having a thickness less than or equal to the predetermined thickness threshold may contact the cam member 32 as the articles are inserted further into the throat 14. However, the articles might not have enough thickness, and thus might not provide enough friction against the cam member 32, to sufficiently rotate the cam member 32 so that the cam mechanism 23 may engage the articles. As the articles having a thickness equal to or below the predetermined thickness threshold are inserted further into the throat 14 and come into contact with the cutter elements 21, the articles may be shredded by the shredder mechanism 20. In embodiments having the activation sensors, the insertion of the articles into the throat 14 activates the activation sensors, which then send signals to the controller to operate the shredder mechanism 20 to drive the cutter elements 21. As shown in FIG. 5*b*, articles having thickness equal to or below the predetermined maximum thickness threshold may be inserted past the gap 42 and further into the throat 14 to be shredded by the shredder mechanism 20.

Figure 6A:
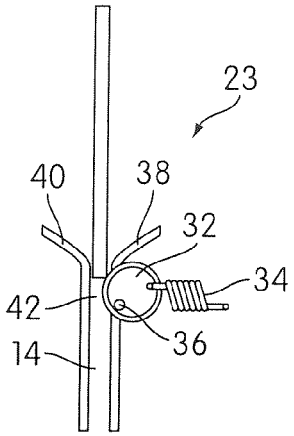
FIGS. 6*a*-6*c* are detailed views of the operation of the cam mechanism shown in FIGS. 4*a*-4*b;*
Figure 6B:
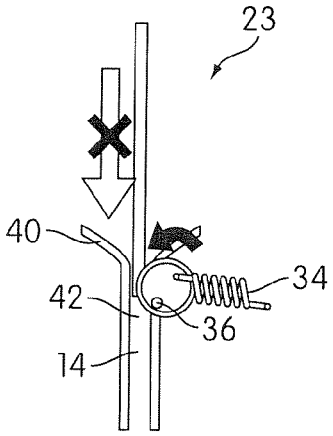

FIG. 6*a* shows the cam mechanism 23 in the disengaged position before articles having thickness above the predetermined thickness threshold are inserted into the throat 14. In this embodiment, the cam mechanism 23 is in the disengaged position wherein the spring 34 is in the default, relaxed state and the cam member 32 is disposed near the first side 38 of the throat 14. As shown, the cam mechanism 23 is constructed and arranged such that when articles having thickness above the predetermined thickness threshold are inserted into the throat 14 and into the gap 42, the articles contact the cam member 32 and the second side 40 of the throat 14. As the articles are pushed in a downward direction further into the throat 14, friction between the articles and the outside surface of the cam member 32 "drags", or pulls, the cam member 32 in a downward direction, causing the cam member 32 to rotate in a counterclockwise direction around the pivot point 36 towards the second side 40 of the throat 14. In the embodiment shown in FIG. 6*b*, the cam member 32 is constructed and arranged to engage the articles and to decrease the size of the gap 42 until the articles are no longer able to be further inserted into the throat 14 when the cam member 32 is rotated in the counterclockwise direction towards the second side 40 of the throat 14. The rotation of the cam member 32 may cause the cam member 32 to force the articles against the second side 40 of the throat 14 and thus retain the articles between the cam member 32 and the second side 40 of the throat 14. The spring 34 may be configured to extend during the counterclockwise rotation of the cam member 32. The engagement of the articles by the cam mechanism 23 and the resulting inability to insert the articles into the throat 14 indicates to a user that the thickness of the articles must be reduced.

Figure 6C:
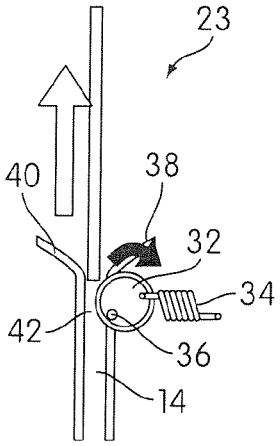

As shown in FIG. 6*c*, the user may remove the articles from their position between the second side 40 of the throat 14 and the engaged cam mechanism 23 by pulling the articles in an upward direction. Accordingly, the friction between the articles and the cam member 32 resulting from the upward motion of the articles may cause the cam member 32 to rotate in a clockwise direction around the pivot point 36 so that the size of the gap 42 is increased and the articles are no longer engaged by the cam member 32. As such, the extended spring 34 may then rotatably snap the cam member 32 back to the disengaged position.

Figure 7A:
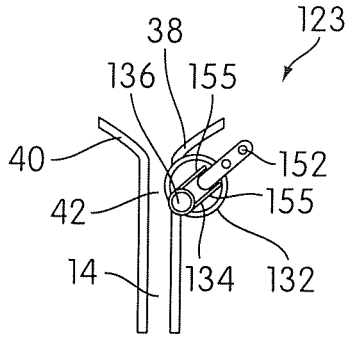
FIGS. 7*a*-7*b* are detailed views of a cam mechanism in accordance with a second embodiment of the present invention.
Figure 7B:
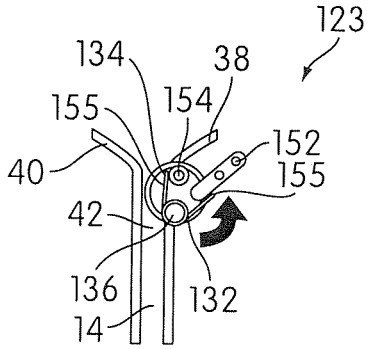

FIGS. 7*a*-7*b*, 8*a*-8*b*, and 9*a*-9*c* illustrate an alternative embodiment of the invention and the operation thereof. In the embodiment shown in FIG. 7*a*, the cam mechanism 123 includes a torsion spring 134. In this embodiment, the cam mechanism 123 further includes a position guide 152 attached to a portion of the shredder 10. The position guide 152 may be fixed such that the position guide 152 remains stationary regardless of the movement of the cam member 132 and the spring 134. As shown in FIG. 7*a*, the cam mechanism 123 may generally be biased in the disengaged position wherein the cam member 132 permits further insertion of articles into the throat 14. The cam member 132 may be spaced apart from the second side 40 of the throat 14 to define the gap 42 through which the articles must pass to be further inserted into the throat 14. When the cam mechanism 123 is in the disengaged position, the spring 134 may be in a default, relaxed position. In contrast, in the embodiment shown in FIG. 7*b*, the cam mechanism 123 is in the engaged position wherein the cam member 132 prevents further insertion of articles into the throat 14. In the engaged position, the cam member 132 is closer in proximity to the second side 40 of the throat 14 than in the disengaged position and the size of the gap 42 is reduced so that articles may not be further inserted into the throat 14.

Figure 8A:
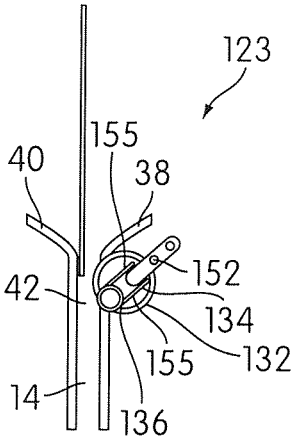
FIGS. 8*a*-8*b* are detailed views of the operation of the cam mechanism shown in FIGS. 7*a*-7*b;*
Figure 8B:
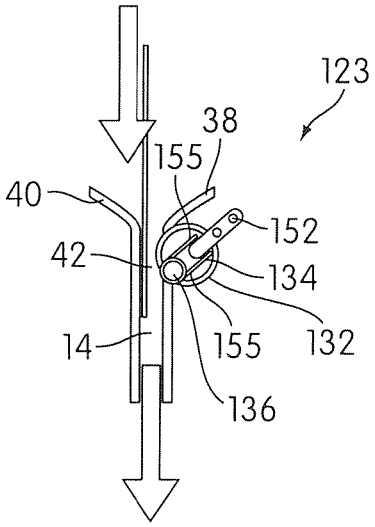

FIGS. 8*a* and 8*b* illustrate the insertion of articles having thickness less than or equal to the predetermined thickness threshold into the throat 14. In FIG. 8*a*, the cam mechanism 123 is in the disengaged position wherein the cam member 132 does not obstruct the throat 14. As shown in FIG. 8*b*, the articles are able to pass through the gap 42 to be further inserted into the throat 14 without the cam mechanism 123 engaging the articles. The articles are then able to be shred by the shredder mechanism 20 as the articles come into contact with the cutter elements 21.

Figure 9A:
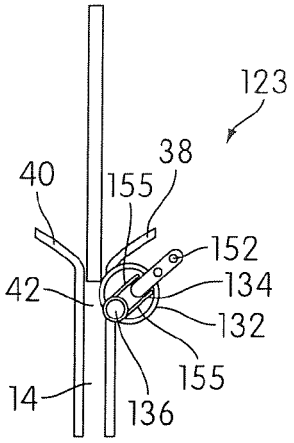
FIGS. 9*a*-9*c* are detailed views of the operation of the cam mechanism shown in FIGS. 7*a*-7*b;*
Figure 9B:
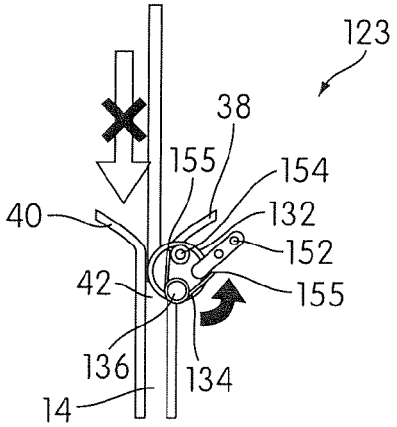
Figure 9C:
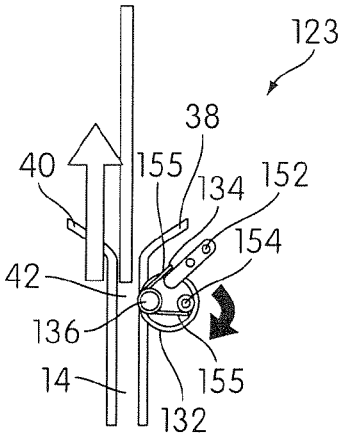

FIGS. 9*a*-9*c* illustrate the insertion into the throat 14 and the removal from the throat 14 of articles having thickness above the predetermined thickness threshold. In FIG. 9*a*, the cam mechanism 123 is in the disengaged position wherein the spring 134 is in the default position and the cam member 132 is not engaging the articles so that the articles may be inserted past the gap 42 to be further inserted into the throat 14. In this embodiment, the cam member 132 includes a stop member 154 positioned between two arms 155 of the spring 134. In one embodiment, when the cam mechanism 123 is in the disengaged position, the position guide 152 overlaps the stop member 154, as shown in FIG. 9*a*.

FIG. 9*b* illustrates the insertion of articles having thickness above the predetermined thickness threshold into the throat 14. As shown in FIG. 9*b*, the articles have sufficient thickness such that the friction between the articles and the cam member 132 "drags", or rotates, the cam member 132 downwardly in a counterclockwise direction around the pivot point 136. As the cam member 132 is rotated downwardly in a counterclockwise direction, the spring 134 is extended by the position guide 152 on one arm 155 of the spring 134 and by the stop member 154 on the other arm 155 of the spring 134.

Referring back to FIG. 9*b*, the articles are prevented from traveling further into the throat 14 by the cam member 132. The engagement of the articles by the cam mechanism 123 and the resulting inability to further insert the articles into the throat 14 indicates to a user that the thickness of the articles must be reduced. The user may then remove the articles from their position between the second side 40 of the throat and the engaged cam mechanism 123 by pulling the articles in an upward direction, as shown in FIG. 9*c*. In the embodiment shown in FIG. 9*c*, the friction created between the articles and the cam member 132 when the articles are pulled in the upward direction causes the cam member 132 to rotate in a clockwise direction towards the first side 40 of the throat 14. Accordingly, the cam member 132 is rotated out of the throat 14 and the spring 134 is extended by the position guide 152 and the stop member 154. In this Figure, the position of the position guide 152 relative to the stop member 154 is opposite of that shown in FIG. 9*b*. The cam mechanism 123 in this extended position facilitates the removal of the articles from the throat 14. After the articles have been pulled completely from the throat 14, the spring 134 may rotatably snap the cam member 132 back to the default disengaged position (as shown in FIG. 7*a*).

Figure 10A:
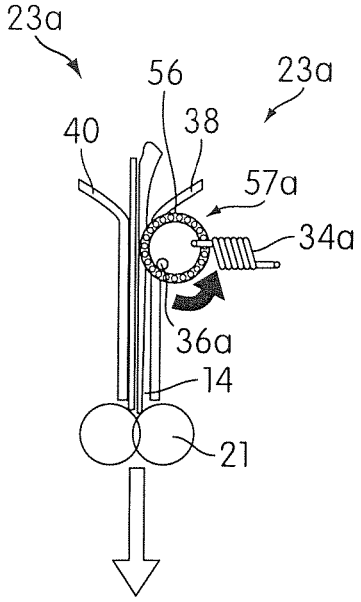
FIG. 10*a* is a detailed view of a cam mechanism in accordance with a third embodiment of the present invention.
Figure 10B:
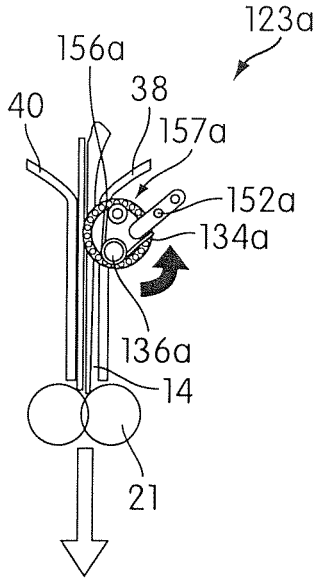
FIG. 10*b* is a detailed view of a cam mechanism in accordance with a fourth embodiment of the present invention.

FIG. 10*a* illustrates an embodiment of the cam mechanism 23*a* having a slip disk 57*a*. Similarly, FIG. 10*b* illustrates an embodiment of the cam mechanism 123*a* having the slip disk 157*a*. Because the cam mechanism 23*a* in FIG. 10*a* is generally similar to cam mechanism 23, similar reference numerals will be used in FIG. 10*a*, but with an "a" added. In addition, because the cam mechanism 123*a* in FIG. 10*b* is generally similar to cam mechanism 123, similar reference numerals will be used in FIG. 10*b*, but with an "a" added.

Figure 11:
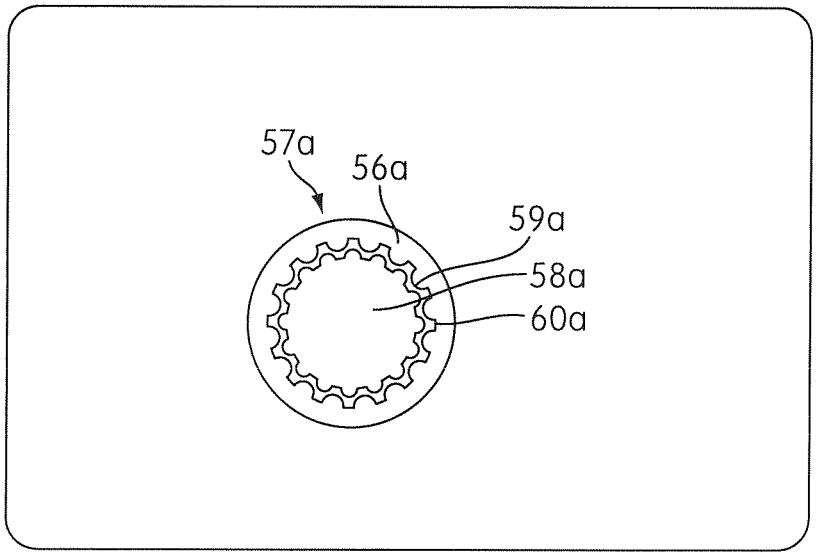
FIG. 11 is a detailed view of an outer ring in accordance with an embodiment of the present invention.

The slip disk 57*a* of the embodiment shown in FIG. 10*a* is shown in detail in FIG. 11. The slip disk 57*a* may comprise an outer ring 56*a* that is retained on a hub 58*a* via notches 60*a* located around the circumference of the hub 58*a*. It is contemplated that the hub 58*a* may be made of plastic, metal, wood, or any other materials known in the art. The outer ring 56*a* may be constructed and arranged to be rotatable relative to the hub 58*a*. The outer ring 56*a* is preferably made of rubber, but may be made of other materials known in the art. The slip disk 157*a* of the embodiment shown in FIG. 10*b* may be similar to the slip disk 57*a* shown in FIG. 11.

In the embodiment shown in FIG. 4*a*, when articles having a thickness equal to or less than the predetermined thickness threshold are able to be further inserted into the throat 14, wrinkles may accumulate on the articles. In one embodiment, the wrinkles on the articles may exert drag on the cam member 32, thus causing the cam member 32 to be rotated in the counterclockwise direction towards the engaged position. As such, the cam mechanism 23 may engage the articles and retain the articles between the cam member 32 and the second side 40 of the throat 14. However, if the articles have already been inserted far enough down the throat 14 to contact the cutter elements 21, the rotation of the cutter elements 21 may pull one portion of the articles in a downward direction while the other portion is engaged and retained by the cam member 32 against the second side 40 of the throat 14. Accordingly, the articles may tear or the cam mechanism 23 may break. In the embodiment shown in FIG. 10*a*, the slip disk 57*a* thus allows the articles to "slip out" or be disengaged from the engaged position between the cam member 32*a* and the second side 40 of the throat 14 when the articles are being pulled in the downward direction by the cutter elements 21. Similarly, in the embodiment shown in FIG. 10*b*, the slip disk 157*a* facilitates the removal of the articles from the engaged position between the cam member 132*a* and the second side 40 of the throat 14.

Specifically, the outer ring 56*a* is fixed to the hub 58*a* in a releasable or clutched manner such that, if a torque above a predetermined threshold is applied to the ring 56*a*, it will release and rotate about the hub 58*a*. In the illustrated embodiment, this is achieved by the ring 56*a* having resilient teeth 59*a* on the inner surface thereof, and the hub 58*a* having notches 60*a* on the outer surface thereof When the torque meets the threshold, the resilient teeth 59*a* will yield, thus disengaging from the notches 60*a* and permitting rotation between the ring 56*a* and the hub 58*a*. The resiliency of the teeth 59*a* enables them to re-engage the notches 60*a* to re-establish the rotationally fixed relationship.

The resilient teeth 59*a* and notches 60*a* may be reversed on the ring 56*a* and hub 58*a*. Other arrangements may also be used, such as resilient intermeshing teeth on both the ring 56*a* and hub 58*a* inner and outer surfaces. Likewise, a frictional engagement between the ring 56*a* and hub 58*a* could also be used. Any releasable or clutch engagement between the ring 56*a* and hub 58*a* may be used.

The predetermined thickness threshold may be varied by varying the location of the pivot point, the radius of the cam member, and the elasticity of the spring. It is contemplated that the configurations and arrangements of the components of the cam mechanisms may be varied depending on the sizes of the throats in different embodiments and the preferred predetermined thickness thresholds.

Figure 12A:
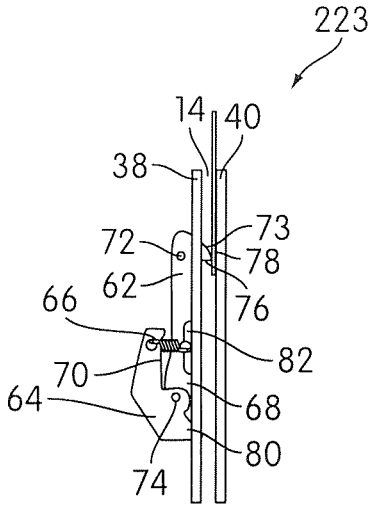
FIGS. 12*a*-12*b* are detailed views of a cam mechanism in accordance with a fifth embodiment of the present invention.
Figure 12B:
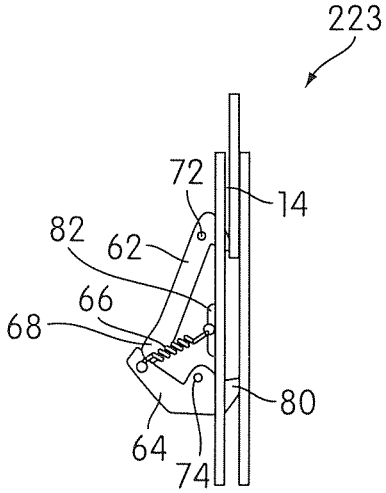

FIGS. 12*a*-12*b* show another embodiment of the present invention. The cam mechanism 223 shown in FIGS. 12*a*-12*b* includes a cam arm 62 and a blocking arm 64 disposed near a first side 38 of the throat 14. As noted previously, the first side 38 of the throat 14 and the second side 40 of the throat are spaced apart to define the thickness of the throat 14. The cam mechanism 223 is movable between an open position or disengaged position wherein the articles are permitted to be further inserted into the throat 14 and a closed position or engaged position wherein the articles are prevented from being further inserted into the throat 14. In the embodiment shown in FIG. 12*a*, the cam arm 62 is operatively connected to a portion of the shredder 10 at a pivot point 72 and the blocking arm 64 is operatively connected to a portion of the shredder 10 at a second pivot point 74. It is contemplated that the attachment mechanisms may be pins, fasteners, and/or other attachment mechanisms known in the art. A spring 66 may be operatively connected to the blocking arm 64 and to the shredder 10 at an attachment portion 82 provided near the first side 38 of the throat 14. In one embodiment, the cam arm 62 includes a contact portion 76 that extends into the throat 14. In one embodiment, the contact portion 76 and the second side 40 of the throat 14 are spaced apart to define the gap 42 through which the articles must pass to be further inserted into the throat 14, wherein the gap 42 is smaller than the thickness of the throat 14. The cam arm 62 may include a camming portion 68 that is constructed and arranged to contact a camming surface 70 of the blocking arm 64. The blocking arm 64 may include a blocking portion 80 that extends into the throat 14 and is configured to block the throat 14 when the cam mechanism 223 is in the closed position. Furthermore, the cam mechanism 223 may be constructed and arranged to move to the closed position when the contact protrusion is pushed against with sufficient force, as will be described later.

Articles having thickness below or equal to the predetermined thickness threshold may be inserted into the throat 14 and past the gap 42 without moving the cam mechanism 223 to the closed position. However, when articles having thickness above the predetermined thickness threshold are inserted into the throat 14, the articles may push against the contact portion 76 of the cam mechanism 223 sufficiently to actuate the cam mechanism 223 to the closed position. As shown in FIG. 12*b*, when the cam mechanism 223 is in the closed position, the cam mechanism 223 blocks the throat to prevent articles from being further inserted into the throat 14.

In the embodiment shown in FIG. 12*a*, articles having thickness below or equal to the predetermined thickness threshold are able to be inserted into the throat and past the gap 42 without actuating the cam mechanism 223 to the closed position. However, as shown in FIG. 12*b*, the insertion of articles having thickness above the predetermined thickness threshold into the throat 42 may actuate the cam mechanism 223 to the closed position. When the articles having thickness above the predetermined thickness threshold are inserted into the gap 42 in the throat 14, the articles push against a contact surface 73 of the contact portion 76 of the cam arm 62. The friction between the contact surface 73 and the articles push the contact portion 76 in a downward direction and thus pivots the cam arm 62 around the pivot point 72 in a clockwise direction. The cam arm 62 is constructed and arranged to pivot the blocking arm 64 when the cam arm 62 is pivoted. Specifically, when the cam arm 62 pivots around the pivot point 72, the camming portion 68 of the cam arm 62 may push and slide against the camming surface 70 of the blocking arm 64, thus pivoting the blocking arm 64 in a clockwise direction around the pivot point 74 of the blocking arm 64. In this embodiment, the blocking portion 80 is designed to extend into the throat 14 and block the throat 14 when the blocking arm 62 is pivoted in a clockwise direction, so that the articles may not be further inserted into the throat 14. The spring 66 may be configured and arranged to extend when the blocking arm 64 is pivoted in the clockwise direction. In contrast, when the thick articles are removed from the gap 42 between the contact portion 76 and the second side 40 of the throat 14, the articles no longer push against the contact portion 76 and the spring 66 is able to snap back to its default relaxed position. In this embodiment, the spring 66 is configured to rotate the blocking arm 64 in a counterclockwise direction to the open position when the spring 66 snaps back to the default position, so that the blocking portion 80 is retracted from the throat 14 and is no longer blocking the throat 14. The rotation of the blocking arm 64 may cause the camming surface 70 of the blocking arm 64 to push against the cam portion 68 of the cam arm 62 and thus pivot the cam arm 62 in a counterclockwise rotation back to the open position. It is contemplated that in some embodiments, the articles may have a thickness much greater than the predetermined thickness threshold such that the contact portion 76 may engage the articles and retain the articles between the contact portion 76 and the second side 40 of the throat 14.

Figure 13A:
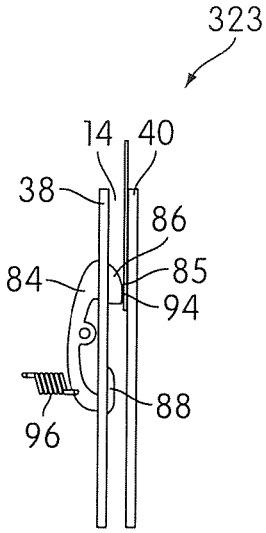
FIGS. 13*a*-13*b* are detailed views of a cam mechanism in accordance with a sixth embodiment of the present invention.
Figure 13B:
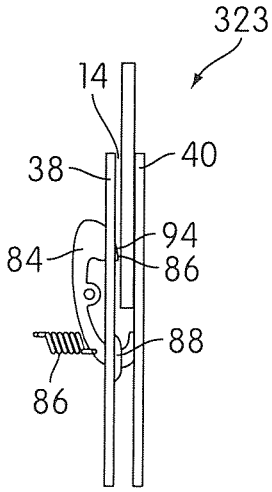

FIGS. 13*a*-13*b* show another embodiment of the present invention. In this embodiment, the cam mechanism 323 includes a cam arm 84 having a contact portion 86 and a blocking portion 88. The cam mechanism 323 may be provided near a first side 38 of the throat, and a spring 96 may be operatively connected to the cam arm 84 and to a portion of the shredder 10. In this embodiment, the cam mechanism 323 is constructed and arranged to move between the open position wherein the articles are permitted to be further inserted into the throat 14 (as shown in FIG. 13*a*) and the closed position wherein the articles are prevented from being further inserted into the throat 14 by the blocking portion 88 of the cam mechanism 323 (as shown in FIG. 13*b*). The cam mechanism 323 may be constructed and arranged to block the throat 14 when the cam mechanism 323 is actuated by the insertion into the throat 14 of articles having thickness above the predetermined thickness threshold. The spring 96 may be configured and arranged to be in a default, relaxed position when the cam mechanism is in the open position and in an extended position when the cam mechanism 323 is in the closed position. In addition, the contact portion 86 and the second side 40 of the throat 14 may be spaced apart to define the gap 42 through which articles must pass to be further inserted into the throat 14.

As shown in FIG. 13*a*, articles having a thickness below or equal to the predetermined thickness threshold do not exert enough force on the contact portion 86 of the cam mechanism 323 to move the cam mechanism 323 to the closed position. The articles may pass through the space 94 without actuating the cam mechanism 323 to block the throat 14. However, as shown in FIG. 13*b*, articles having thickness above the predetermined thickness threshold may actuate the cam mechanism 323 to block the throat 14.

As shown in FIG. 13*b*, when articles having thickness above the predetermined thickness threshold are inserted into the gap 42, the articles push against a portion of the contact portion 86 of the cam arm 84. The articles are of sufficient thickness that they may push the contact portion 86 away from the throat 14 and thus pivot the cam arm 84 in a counterclockwise direction. The pivoting of the cam arm 84 in the counterclockwise direction causes the blocking portion of the cam arm 84 to extend into the throat and block the throat 14 so that the articles may not be further inserted into the throat 14. The spring 96 may be configured and arranged to extend when the cam arm 84 is pivoted. When the user is not able to further insert the articles into the throat, this indicates to the user that the number of articles must be reduced. The user may then pull the articles out of the throat 14. In one embodiment, when the thick articles are removed from the gap 42 between the contact portion 86 and the second side 40 of the throat 14, the articles no longer push against the contact portion 86 and the spring 96 is able to snap back to its default relaxed position. As such, the spring 96 may rotate the cam arm 84 in a counterclockwise direction back to the open position. Accordingly, the blocking portion 88 of the cam mechanism 323 is retracted from the throat 14 and is no longer blocking the throat 14.

It is contemplated that in some embodiments, the shredder 10 may also include an indicator 98 (see FIG. 14) configured to indicate the insertion into the throat 14 of articles above the predetermined maximum thickness threshold. The indicator 98 may be an LED, an audible alarm, or other feedback mechanisms known in the art. The indicator 98 may be activated by the movement of the cam mechanism 23 and/or by the position of the cam mechanism 23. For example, the indicator 98 may be activated when the cam mechanism 23 is in the engaged or closed position. The indicator 98 may provide a warning signal, or emit light, when the indicator 98 is activated for a predetermined amount of time. In one embodiment, the indicator 98 does not provide a warning signal when a wrinkle in the article passes through the cam mechanism 23 such that the cam mechanism 23 is in the engaged or closed position only briefly (less than the predetermined amount of time).

Figure 14:
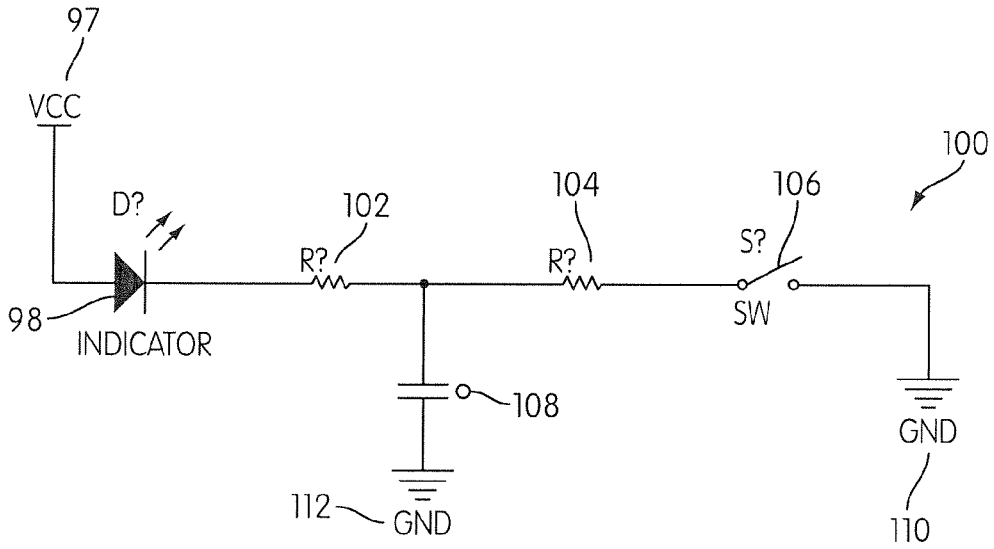
FIG. 14 illustrates a circuit diagram showing steps for emitting light using an LED as the indicator in accordance with an embodiment of the present invention.

FIG. 14 illustrates a circuit diagram 100 showing steps for emitting light using an LED as the indicator 98 in accordance with an embodiment of the present invention. The circuit 100 may be connected to the controller which may enable delivery of power to the indicator 98. The circuit 100 may include a voltage supply Vcc 97, indicator 98, resistors 102, 104, a switch 106, a capacitor 108, and circuit grounds 110, 112. Although a single LED is shown, it is contemplated that one or more LEDs, such as an array or series of LEDs may be provided. In this embodiment, when the switch 106 is an open position wherein current is prevented from flowing through the circuit 100, the indicator 98 does not emit light. When the switch 106 is in the closed position such that the current may flow through the circuit 100, the capacitor 108 will charge based on the time constant of a resistor-capacitor network (defined by resistor 102 and capacitor 108). Once the capacitor 108 has been charged to a predetermined level, the indicator 98 may emit light. When the switch 106 is in the open position again, the capacitor may discharge and there may be a delay before the indicator 98 will no longer emit light. The capacitor 108 may charge and discharge according to the following equation:

$$Q(t)=Q_0e^{-t/RC}$$

where $Q_0$ is the initial charge, $\tau$ is the time constant (or elapsed time), R is the resistance value, and C is the capacitance value. The time constant $\tau$ represents the time for the system to make significant change in charge, voltage, or current whenever a capacitor 108 is charging or discharging. In this embodiment, the indicator 98 will illuminate based on the time constant $\tau$. In one embodiment, the predetermined amount of time may be determined by the time constant of the resistor-capacitor network.

In the embodiment shown in FIG. 14, the circuit 100 includes a low-pass filter (LPF) defined by the resistor 102 and the capacitor 108. The LPF is configured to eliminate or reduce the possibility of the indicator 98 flickering during the shredding process. Flickering may be caused by the forceful movement of the cutter elements 21 as the cutter elements 21 are shredding the articles, which may trigger the switch 106 momentarily. The switch 106 may also be triggered momentarily by the wrinkles that accumulate on the articles as the articles are being shredded. The variables in the above mentioned equation may be varied to obtain the optimal indicator drive and filter timing. For example, the value of the resistor 102 or the value of the capacitor 108 may be increased to increase the predetermined amount of time for the switch 106 to be depressed before the indicator 98 will illuminate. The resistor 102 and capacitor 108 values may also be changed to increase or decrease the amount of filtering required. For example, the more aggressive the cutter elements 21, the more filtering is required to prevent the indicator 98 from flickering. The embodiment shown in FIG. 14 is an example and is not intended to be limiting. It is contemplated that the filter may be omitted entirely in some embodiments. In other embodiments, filtering may be accomplished by using logic and/or software. It is also contemplated that in some embodiments, the configuration and arrangement of the circuits may vary. In some embodiments, the indicator 98 may be powered from an AC line.

FIG. 15 shows the thickness detector 250 and the blocking member 256 in accordance with one embodiment of the invention. In this embodiment, the thickness detector 250 includes the movable member 251 having the contact portion 252 that extends into the throat 14. The movable member 251 is configured to pivot around pivot point 255, which may be defined by a pin, rivet, or other mechanisms. The movable member 251 may be attached to the shredder 10 at pivot point 255 near the first side 38 of the throat 14. The movable member 251 may be made of metal, plastic, other materials, or any combination thereof.

In this embodiment, the second side 40 of the throat 14 and the contact portion 252 of the movable member 251 are spaced apart to define a gap 42 through which articles may pass when the movable member 251 is in the retracted position. An actuating portion 271 is provided on an end of the movable member 251 opposite to the contact portion 252. The actuating portion 271 is configured to contact an extending member 260 of a switch 262, such as a lever switch, so as to actuate the switch 262 when the movable member 251 is actuated in response to the thickness of the articles inserted into the throat 14 being above the predetermined thickness threshold.

A blocking mechanism 254, which may take the form of a solenoid in this embodiment, includes a blocking member 256. The blocking mechanism 254 may be considered an actuator that actuates the blocking member 256 to move between the retracted and extended positions. The blocking member 256 is constructed and arranged to extend into the throat 14 when the blocking mechanism 254 is activated (or energized), so as to block the throat 14 to prevent further insertion of articles therein. In this embodiment, the energization of the blocking mechanism 254 is effected by the switch 262. That is, when the switch 262 is actuated, electric current is sent through the wires of the blocking mechanism 254. Because the blocking mechanism 254 in this embodiment is a solenoid, the blocking member 256 may be an inner shaft of the solenoid that may be made of iron or steel. When the blocking mechanism 254 is energized, the magnetic field within the blocking mechanism 254 applies a force to the blocking member 256 to repel it so that it would extend into the throat 14. When the magnetic field in the blocking mechanism 254 is turned off, a spring (not shown) returns the blocking member 256 back to the retracted position.

In this embodiment, the blocking member 256 has a roller 258 attached to an end that is extended into the throat 14. The roller 258 is constructed and arranged to rotate around a point 260, which may be defined by a rivet or pin used to attach the roller 258 to the blocking member 256. The roller 258 may optionally be made of plastic or rubber, or may be provided with such materials on the surface thereof. The roller 258 may be spaced from the second wall 40 so as to define a space 259 through which articles must pass to be shredded by the cutter elements 221. In one embodiment, an opening (not shown), which may be a through hole opening or the opening of a recess, may be provided on the second side 40 of the throat 14. The opening may be constructed and arranged to receive the roller 258 and the blocking member 256 when the blocking member 256 is fully extended into the throat 14 (see FIG. 16). The blocking member 256 may be considered to be in the extended position even when the roller 258 of the blocking member 256 is not received within the opening. That is, the blocking member 256 may be considered to be in the extended position when the blocking member 256 is extended far enough into the throat 14 that articles cannot be further inserted into the throat 14 past the blocking member 256. The roller 258 may be optional and in some embodiments, the blocking member 256 does not have a roller 258 attached thereto. Other types of blocking members may be used in other embodiments, such as, for example, a linear rack driven by a motor rotated pinion.

The blocking member 256 may be extended with a predetermined force so that the roller 258 may enter the opening of the second side 40 of the throat 14 when no articles are between the roller 258 and the opening. The predetermined force may be calculated and determined to be of a certain amount so that the blocking member 256 can enter the opening when no articles are present between the roller 258 and the opening, but will not cause portions of the articles to be pushed into the opening when articles are present (even when only one sheet of paper is present). In some embodiments, the user may set the predetermined force. The predetermined force may optionally be calculated using logic, software, and/or rules. In addition, the switch 262, when actuated, is configured to activate the blocking mechanism 254 to extend the blocking member 256 into the throat 14. The operation of the movable member 251, the switch 262, and the blocking member 256 will be described in more detail later.

As shown in FIG. 15, when articles below the predetermined threshold are inserted into the throat 14, the articles are able to pass through the gap 42 without actuating the thickness detector 250 by moving the movable member 251. Specifically, when the articles have a thickness that is below or equal to the predetermined thickness threshold, the articles do not contact the contact portion 252 of the movable member 251, or do not contact the contact portion 152 with sufficient force, to pivot the movable member 251 sufficiently so that the switch 262 can be actuated. Thus, in this situation, the blocking member 256 is not extended into the throat 14, and the articles are able to be inserted past the space 259 to be shredded by the cutter elements 221.

Figure 16:
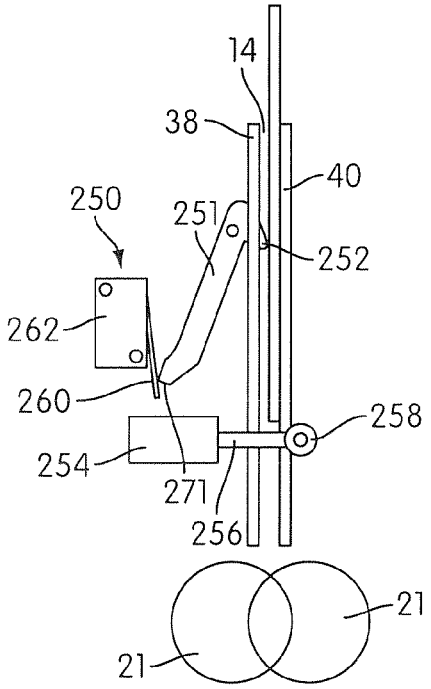
FIGS. 16-18 illustrate the operation of the thickness detector and the blocking member in accordance with the embodiment of FIG. 4.

FIG. 16 illustrates the operation of the thickness detector 250 and blocking member 256 of the embodiment shown in FIG. 15 when articles having thickness above the predetermined thickness threshold is inserted. As shown in this embodiment, the articles inserted into the throat 14 are of sufficient thickness that they may push the contact portion 252 of the movable member 251 away from the throat 14 and thus pivot the movable member 251 in a counterclockwise direction. When the movable member 251 is pivoted sufficiently so that the actuating portion 271 of the movable member 251 pushes against the extending member 260 of the switch 262, the switch 262 becomes actuated. As a result, a signal is generated to the controller 223, which then activates the blocking mechanism 254 to extend the blocking member 256. The blocking member 256 is then extended into the throat 14 and into the opening, as shown in FIG. 16. Accordingly, the blocking member 256 blocks the throat 14 and prevents further insertion of articles therein. Because the blocking mechanism 254 is between the shredder mechanism 20 and the thickness detector 250, this can occur before the articles have reached the blocking member 256. Other devices or other types of actuators for extending the blocking member 256 may be used, and is not limited to the blocking mechanism 254 described in this embodiment.

Figure 17:
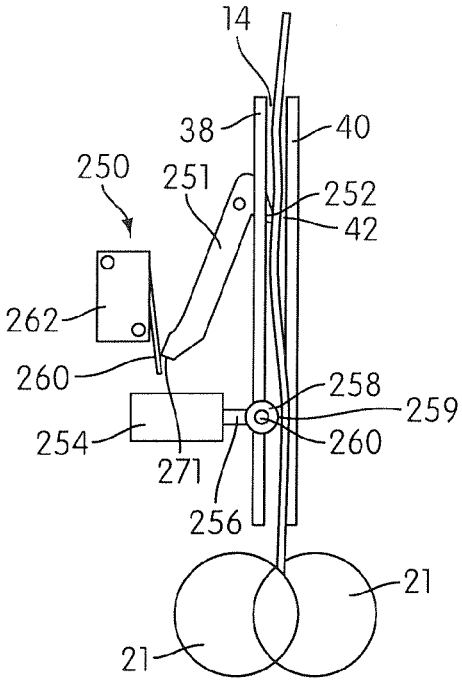

In some situations, wrinkles on the articles may cause the thickness detector 50 to be actuated when the articles are equal to or below the predetermined thickness threshold. For example, as shown in FIG. 17, the articles have already been inserted far enough into the throat 14 for the articles to be received by the cutter elements 21. However, as shown in this Figure, the wrinkles or other textures on the articles cause sufficient force to be applied against the contact portion 252 of the movable member 251 to actuate and pivot the movable member 251 to come into contact with the extending member 260 of the switch 262. As such, the switch 262 is actuated, which then causes the controller 223 to activate the blocking mechanism 254 to extend the blocking member 256 into the throat. It is contemplated that in some embodiments, when the switch 262 is actuated, the switch 262 may close a circuit to send a signal to the blocking mechanism 254 to extend the blocking member 256 into the throat. The articles prevent the blocking member 256 and the roller 258 from extending into the opening of the second side 40 of the throat 14. As a result, the roller 258 of the extending "rides on" or contacts the surface of the articles as the articles are pulled in a downward direction by the rotation of the cutter elements 21. That is, friction resulting from the contact between the roller 258 and the articles causes the roller 258 to rotate around the point 260. This configuration prevents the articles from tearing and/or the blocking member 256 from breaking Accordingly, the articles that have already been inserted into the throat 14 are then able to be shred by the cutter elements 21. When force is no longer applied against the contact portion 52 of the movable member 251, the movable member 251 is biased back to the retracted position by a spring (not shown).

Figure 18:
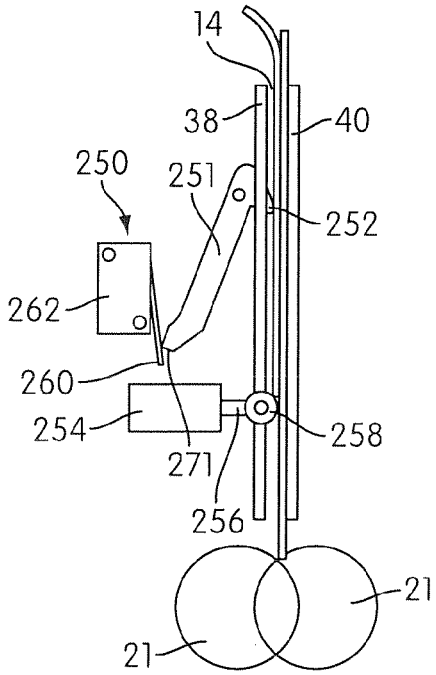

FIG. 18 illustrates the operation of the thickness detector 250 and the blocking member 256 in situations where articles of a thickness below or equal to the predetermined thickness threshold are first inserted into the throat 14 and then more articles are inserted thereafter. When articles having a thickness equal to or below the predetermined thickness (referred hereinafter as "primary articles") are inserted into the throat 14, the articles are able to be inserted through the gap 42 without actuating the thickness detector 250. As such, the articles are able to contact the cutter elements 21 to be shredded. However, when portions of the primary articles are still in the throat 14 and more articles (referred hereinafter as "secondary articles") are inserted into the throat 14, as shown in FIG. 7, the total thickness of the primary and secondary articles may be above the predetermined thickness threshold. The articles having a thickness above the predetermined thickness threshold may contact the contact portion 252 of the movable member 251 sufficiently to actuate the thickness detector 250. When actuated, the movable member 251 is pivoted so that the actuating portion 258 of the movable member 251 pushes against the extending member 260 of the switch 262. The switch 262 is then actuated, which then causes the controller 23 to activate the blocking mechanism 254. When the blocking mechanism 254 is activated, the blocking mechanism 254 extends the extending member 256 into the throat 14. However, because the primary articles are already being pulled downwards by the rotation of the cutter elements 21, the primary articles are between the roller 258 of the blocking member 256 and the opening in the second side 40 of the throat 14. As such, the roller 258 of the blocking member 256 extends into the throat 14 until it comes into contact with the primary articles and pushes the primary articles against the second side 40. The roller 258 then "rides on" on the primary articles, or rotates around point 260 while contacting the primary articles. Because the blocking member 256 has already been extended into the throat 14 and is pushing the primary articles against the second side 40 of the throat 14, the space 259 between the second side 40 of the throat 14 and the roller 258 is sufficiently closed so as to prevent insertion of more articles through the space 259. That is, the secondary articles are prevented from being further inserted into the throat 14 by the blocking member 256 and the roller 258. The secondary articles may come into contact with the blocking member 256 and the roller 258 when the secondary articles are pushed further into the throat 14. As such, the primary articles which has a thickness equal to or below the predetermined thickness threshold are able to be shredded by the cutter elements 21 while the secondary articles are prevented from being inserted further into the throat 14 when the total thickness of the primary articles and the secondary articles are above the predetermined thickness threshold.

Figure 19:
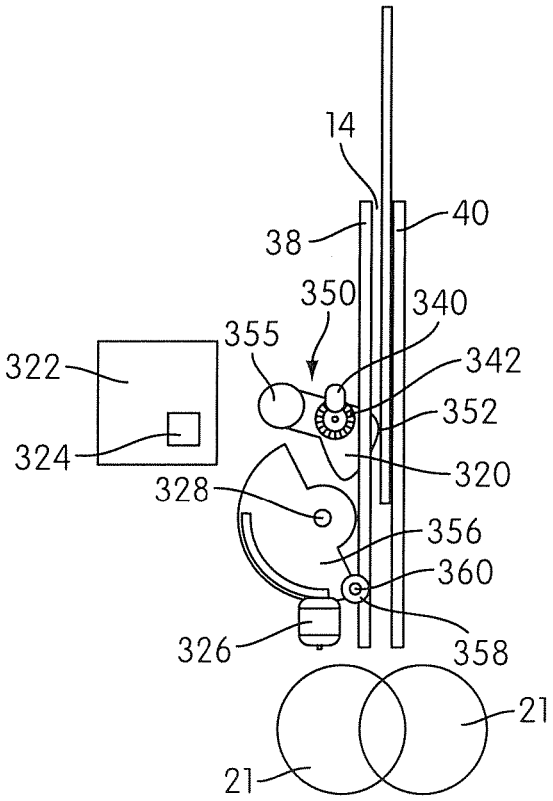
FIG. 19 is a detailed view of a thickness detector and a blocking member in accordance with another embodiment of the present invention.

FIG. 19 illustrates another embodiment of the blocking member 356 and the thickness detector 350. In this embodiment, the thickness detector 350 includes a contact member 320 and an optical sensor 340. The contact member 320 is pivotally mounted at pivot point 355 (which may be defined by a rivet, pin, or other attachment mechanism) such that the contact portion 352 extends into the throat 14 and a plurality of rotation indicators 342 is provided thereon outside of the throat 14. The optical sensor 340 may be configured to sense the rotation indicators 342 as the rotation indicators 342 rotate past the optical sensor 340. For example, the optical sensor 340 may include an infrared LED and a dual die infrared receiver to detect the direction and amount of motion of the contact member 320. Of course, different configurations of the optical sensor 340 and contact member 320 may be used. In addition, other types of sensors may optionally be used. The illustrated embodiment is not intended to be limiting in any way.

In this embodiment, the blocking member 356 is pivotally attached to the shredder 10 at pivot point 328 (which may be defined by a rivet, pin, or other attachment mechanism). The blocking member 356 is attached to the shredder 10 near the second side 40 of the throat 14. The blocking member 356 includes a roller 358 rotatably attached to the blocking member 356 at point 360. The blocking member 356 is driven by motor 326, which is operatively connected thereto. The motor 326 is configured to drive the blocking member 356 responsive to the insertion of articles having a thickness above the predetermined thickness threshold so that the blocking member 356 and the roller 358 extend into the throat 14 to prevent further insertion of the articles therein.

In this embodiment, the optical sensor 340 may be operatively connected to an integrated circuit 322 provided on a printed circuit board 324. The optical sensor 340 provides a signal to the integrated circuit 322, which in turn is communicated to the motor 326 to drive the blocking member 356. The integrated circuit 322 may be programmed with the predetermined thickness threshold value. In some embodiments, a user-provided predetermined thickness threshold value may be programmed. In some embodiments, the distance that the blocking member 356 and the roller 358 is extended into the throat 14 based upon the thickness of the articles detected may be programmed into the integrated circuit 322. Rules, logic, and/or software may be used to determine these values.

When articles having a thickness greater than the predetermined thickness threshold is inserted into the throat 14, the articles contact the contact portion 352 and push the contact member 320 downwards in the clockwise direction. The sensor 340 senses the movement of the contact member 320 by the movement of the rotation indicators 342 and sends a signal to the integrated circuit 322, which in turn communicates to the motor 326 to drive the blocking member 356. The motor 326 extends the blocking member 356 into the throat 14 such that the roller 358 is received in the opening (not shown) provided on the second side 40 of the throat 14. When the blocking member 356 is in this position, the blocking member 356 closes the throat 14 and prevents further insertion of articles therein. After a predetermined amount of time or after the activation sensor or the sensor 340 senses that there are no articles in the throat 14, the motor 326 may drive the blocking member 356 back to the retracted position so that the blocking member 356 and the roller 358 are no longer blocking the throat 14.

Alternatively, in some embodiments, the blocking member 356, by default, may be extended into the throat 14 to prevent the insertion of articles further into the throat 14. In such embodiments, when the thickness detector 350 detects that the thickness of the articles is below the predetermined thickness threshold, the thickness detector 350 may send signals to the integrated circuit 322, which in turn causes the motor 325 to drive the blocking member 356 and the roller 358 to the retracted position so that the throat 14 is no longer blocked. In some embodiments, the thickness detector 350 may be operatively connected to the controller 23 and may send signals to the controller 23 (see FIG. 20). The controller, in turn, may be operatively connected to the integrated circuit 322. In some embodiments, the integrated circuit 322 may be part of the controller.

Although the blocking member 356 has a different construction and arrangement as blocking member 56, which is described above with respect to the embodiment shown in FIG. 15, the blocking member 356 may operate in a similar manner as blocking member 56. For example, the roller 358 of the blocking member v56 is constructed and arranged to "ride on" or rotate on the surface of the articles when wrinkles on the articles activate the contact member 320 to extend the blocking member 356 into the throat 14. As mentioned above, this prevents the articles that are being pulled down by the rotation of the cutter elements 21 from tearing and the blocking member 356 from breaking.

As also mentioned above, in some situations, primary articles (or a first set of articles) having a thickness equal to or below the predetermined thickness threshold may be inserted into the throat 14 and may contact the cutter elements 21. Secondary articles (or the second set of articles) may be inserted into the throat 14 shortly thereafter, whereupon the blocking member 356 is actuated in response to the thickness of the primary and secondary articles being above the predetermined thickness threshold. The contact portion 352 of the contact member 320 is pushed downwards in the clockwise direction, which causes the sensor 340 to sense the movement of the contact member 320 by the movement of the rotation indicators 342. In these situations, the roller 358 of the blocking member 356 is also constructed and arranged to "ride on" or rotate on the surface of the primary articles when secondary articles are inserted into the throat 14. However, because the blocking member 356 and the roller 358 are extended into the throat, the secondary articles are prevented from being further inserted therein. Thus, the primary articles are able to be shredded while the secondary articles are prevented from being further inserted into the throat 14. This prevents the shredder 10 from jamming due to too many articles being fed into the throat 14.

In other embodiments, the thickness sensor 250, 350 may include a contact member that extends into the throat 14 and is actuated in response to the article being inserted into the throat 14. The thickness sensor 250, 350 may include a strain gauge configured to measure movement of the contact member and communicate the movement to the controller 23. In another embodiment, the thickness sensor 250, 350 may include a piezoelectric sensor configured to measure movement of the contact member and communicate the movement to the controller 23. Reference may be made to U.S. Patent Application Publication No. 2006-0219827 A1, which is hereby incorporated by reference, for details of thickness detectors that are configured to detect the thickness of the at least one article received by the throat 14. The detectors may have any construction or configuration, and the illustrated embodiment is not limiting.

Figure 21:
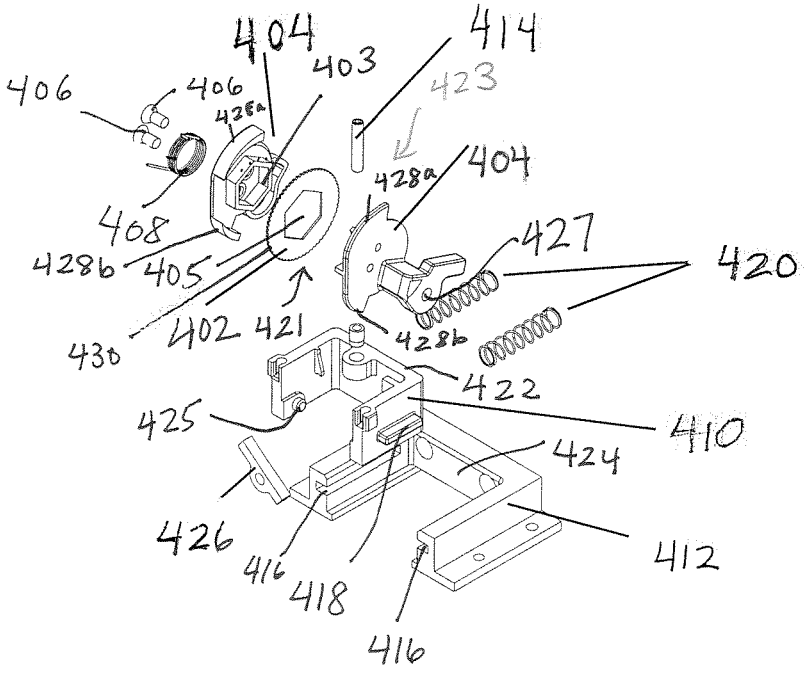
FIG. 21 is an exploded view of a blocking member of the shredder in accordance with an embodiment.

FIG. 21 shows an exploded view of another embodiment of the cam mechanism 423. This cam mechanism 423 includes a cam member 421 having a cam disc 402 and cam arms 404 (two are shown in this embodiment). In this embodiment, the cam disc 402 is received between the cam arms 404, which are attached to each other via assembly screws 406. The cam disc 402 is connected to the cam arms 404 via a hub 403, which has a hexagonal shape in this embodiment. The cam disc 402 includes an opening 405 shaped similar to that of the hub 403, thus enabling the hub 403 to be received in the opening 405. Accordingly, the cam disc 402 may not rotate around the hub 403, and thus the cam disc 402 may not rotate independently of the cam arms 404. However, these examples are not intended to be limiting, and the cam disc 402 may be attached to the cam arms 404 via other mechanisms and/or may be able to rotate independently of the cam arms 404 in other embodiments. The configuration of the cam disc 402 and the cam arms 404 may also vary in other embodiments. The cam disc 402 is constructed and arranged to engage the articles against the second side 40 of the throat 14 (see FIG. 22) so as to prevent further insertion of the articles into the throat 14. The cam disc 402 may include ridges or other patterns along its periphery to facilitate its engagement with the articles. A spring 408 is operatively attached to the cam member 421 so as to enable the cam member 421 to be biased in the disengaged position. The cam member 421 may be pivotably attached to a sliding frame 410. In this embodiment, protrusions 425 of the sliding frame 410 are received in recesses 427 of the cam member 421, thereby rotatably attaching the cam member 421 to the sliding frame 410. The connection between the protrusions 425 and the recesses 427 may define a pivot point 429 (see FIG. 22) of the cam member 421. As such, the cam member 421 may pivot relative to the sliding frame 410 along pivot point 429. The cam member 421 may be pivotably attached to the sliding frame 410 using other attachment mechanisms, such as, just for example, a pin, axle, or fastener. A screw 414, which may be a hex head set screw in one embodiment, may also be used to attach the cam member 421 to the sliding frame 410. It is contemplated that in some embodiments, the sliding frame 410 may be eliminated and the cam member 421 may be attached to the assembly frame 412.

The sliding frame 410 may be slideably received in an assembly frame 412. In one embodiment, the sliding frame 410 includes grooves 416 constructed and arranged to receive sliding structures 418 of the sliding frame 410. The configuration and arrangement of the grooves 416 of the assembly frame 412 and the sliding structures 418 of the sliding frame 410 enable the sliding frame 410 to slide on the assembly frame 412. The assembly frame 412 may be fixed to the shredder in proximity to the first side 38 of the throat 14. Thus, in one embodiment, the sliding frame 410 may slide along an axis generally perpendicular to the first side 38 and second side 40 of the throat 14 (i.e., generally perpendicular to the feeding direction).

A stop structure 426 may also be provided on the sliding frame 410 and/or the assembly frame 412. The stop structure 426 may be constructed and arranged to engage with or contact the screw 414. The stop structure 426 may be pivotable and may be used to adjust the position of the cam arms 404. For example, in one embodiment, the cam arms 404 may be positioned on the sliding frame 410 and the screw 414 may be engaged with the pivotable stop structure 426 to retain the cam arms 404 in a certain position. The position of the cam arms 404 may affect the size of the gap 42 in the throat 14. Accordingly, by adjusting the screw 414, the predetermined thickness threshold (i.e., the thickness of the articles that can be inserted into the throat 14 before the cam mechanism 423 is engaged) may be varied.

Figure 23A:
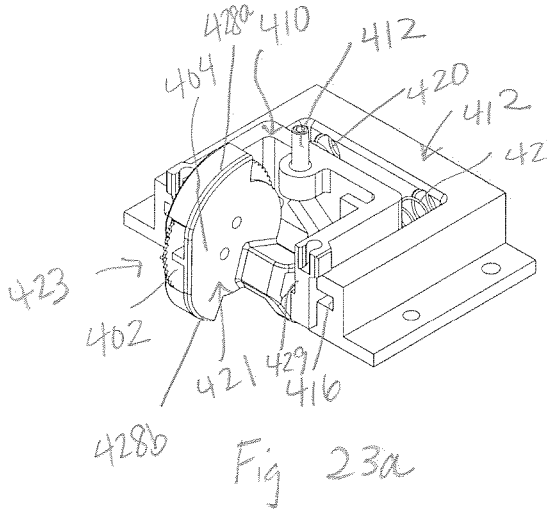
FIGS. 23*a*-23*b* are detailed views of the blocking member of the shredder in accordance with the embodiment shown in FIG. 10.

A relief mechanism may be provided to prevent the cam mechanism 423 from being damaged due to over-rotation or the further movement of the cam member 421 into the throat 14 past the engaged position. As will be described in more detail below, the cam member 421 may become over-rotated or may be pulled further into the throat due to excessive resistance of the articles when the articles are engaged by the cam member 421. In some embodiments, the relief mechanism may take the form of the outer ring 56*a* of the slip disk 57*a* described above. In the embodiment shown in FIG. 21, the relief mechanism takes the form of springs 420 that are provided between the sliding frame 410 and the assembly frame 412. The springs 420 may also be used to bias the assembly frame 412 to a default position, as shown in FIG. 23*a*. In one embodiment, one end of the springs 420 is connected to or engaged with a back portion of the sliding frame 410 and the other end of the springs 420 is connected to or engaged with an inner portion 424 of the assembly frame 412. The examples provided of the relief mechanism are not intended to be limiting, and it is contemplated that the relief mechanism may have other configurations or arrangements. The relief mechanism may be part of the cam mechanism 423 or may be separate from the cam mechanism 423.

Figure 22:
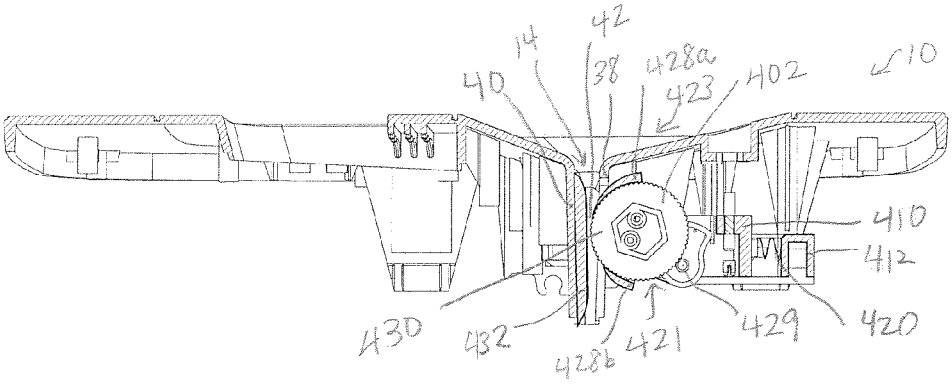
FIG. 22 is a cross sectional view of the blocking member of the shredder in accordance with the embodiment shown in FIG. 10.

As shown in FIG. 22, the cam mechanism 423 may also include deflectors 428*a*, 428*b*. The deflectors 428*a*, 428*b* may be provided along at least a portion of the cam member 421. In one embodiment, the deflectors 428*a*, 428*b* are integral with the cam arms 404. Alternatively or additionally, the deflector 428*a*, 428*b* may be attached to a portion of the throat 14. In one embodiment, a contact portion 430 of the cam disc 402 may be provided between the deflectors 428*a*, 428*b*, wherein the contact portion 430 is constructed and arranged to contact the articles. The contact portion 430 of the cam member 421 and the second side 40 of the throat 14 may define the gap 42 through which articles may pass when the cam mechanism 423 is in the disengaged position. The deflector 428*a* is constructed and arranged to prevent articles that are inserted into the throat 14 from engaging the cam member 421 prematurely. Accordingly, in embodiments where the cam mechanisms 423 are provided with the deflectors 428*a*, 428*b*, the cam mechanism 483 with the deflectors 428*a* are able to deflect articles that are inserted into the throat 14 at an angle towards the second side 40 of the throat. This may help ensure that the articles engage the cam member 421 optimally and within the throat 14 of the shredder 10. The deflectors 428*b* may direct the articles towards the proper path along the throat 14 when the shredder 10 is in the reverse mode (i.e., when the cutter elements 21 are running in a reverse direction). These examples are not intended to be limiting, it is contemplated that the location and number of deflectors 428*a*, 428*b* may vary in other embodiments.

The shredder 10 may also have a centering structure, taking the form of an elongated rib structure 432 in the embodiment shown in FIG. 22. The rib structure 432 may be provided in the throat 14 and may extend into the throat 14 so as to cause the articles that are inserted into the throat 14 to enter the cutter elements 21 at the convergence point (i.e., where the cutter elements 21 of the two mounting shafts overlap). The rib structure 432 may also function as a stop that prevents the cam member 421 from over-rotating (or moving further into the throat 14). In this embodiment, the rib structure 432 is provided on the second side 40 of the throat 14. The contact portion 430 of the cam member 421 may contact the rib structure 432 when the contact portion 430 is in the engaged position. As such, the rib structure 432 may prevent the cam member 421 from over-rotating or moving further into the throat 14. In embodiments with the rib structure 432, the gap 42 may be defined by the contact portion 430 of the cam member 421 and the rib structure 432.

Figure 23B:
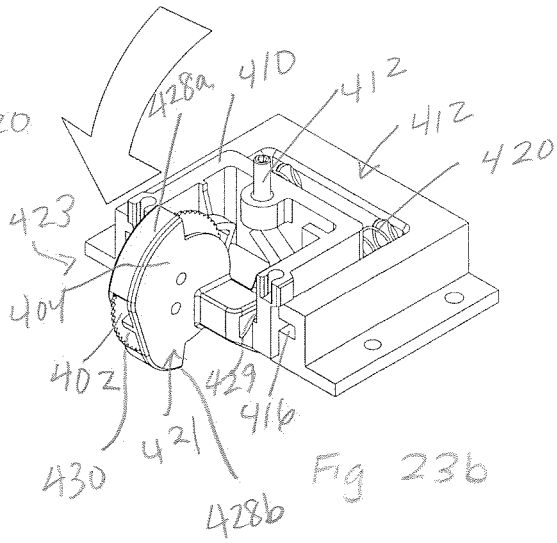

FIGS. 23*a*-23*b* illustrate an operation of the cam mechanism 23 to engage articles that are above the predetermined maximum thickness so as to prevent further insertion of the articles into the throat 14. FIG. 23*a* shows the cam mechanism 423 in the default, disengaged position, wherein the cam mechanism 423 does not obstruct the throat 14 and thus articles can pass through the gap 42 (see FIG. 22) to be further inserted into the throat 14. When articles having thickness lower than the predetermined thickness threshold are inserted into the throat 14, the cam mechanism 23 may retain this position. In contrast, articles having thickness above the predetermined maximum threshold may move the cam mechanism 423 to the engaged position shown in FIG. 23*b*. Articles that are above the predetermined thickness threshold have sufficient thickness such that the friction between the articles and the cam member 421 "drags", or pivots, the cam member 421 downwardly in the counterclockwise direction around the pivot point 429 against the bias of the torsion spring 408. Accordingly, the cam mechanism 423 may be moved to the engaged position as shown in FIG. 23*b* by the insertion of articles having thickness above the predetermined thickness threshold. In the position shown in FIG. 23*b*, the contact portion 430 of the cam member 421 may be closer to the second side 40 of the throat 14 (not shown in this Figure) than in the position shown in FIG. 23*a*, and thus the cam member 421 may retain portions of the articles against the second side 40 of the throat 14. Accordingly, the size of the gap 42 may be reduced as a result such that the articles may not be further inserted into the throat 14.

In embodiments with the rib structure 432, the cam member 421 may retain portions of the articles against the rib structure 432 to prevent further insertion of the articles into the throat 14. In such embodiments, the gap 42 is defined by the distance between the rib structure 432 and the contact portion 430 of the cam member 421, and thus, the size of the gap 42 when the cam mechanism 423 is in this engaged position is smaller than the size of the gap 42 when the cam mechanism 423 is in the position shown in FIG. 23*a*.

Figure 24A:
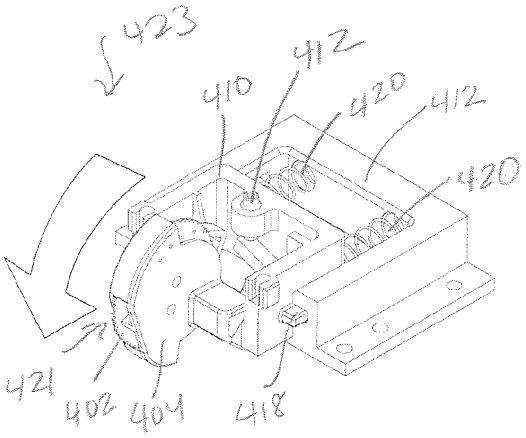
FIGS. 24*a*-24*b* illustrate the operation of the blocking member of the shredder in accordance with the embodiment shown in FIG. 10.
Figure 24B:
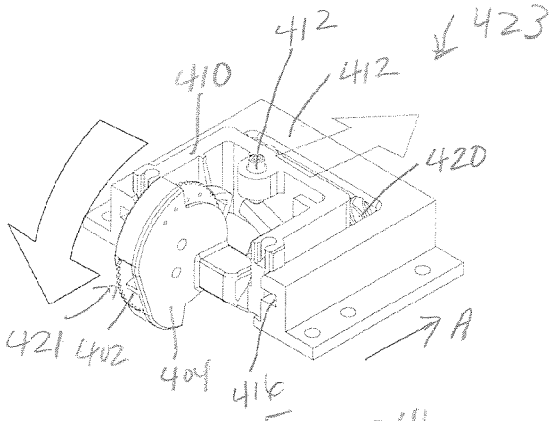

FIGS. 24*a*-24*b* illustrate operation of the cam mechanism 423 and the relief mechanism. In this embodiment, the relief mechanism takes the form of the springs 420. The relief mechanism may be useful when the cam member 421 is moved to the engaged position and is pulled further down into the throat 14 due to excessive resistance of the articles. For example, articles having a thickness equal to or less than the predetermined thickness threshold are able to be further inserted into the throat 14, but wrinkles or folds may accumulate on the articles, thus causing excessive resistance. In such situations, the wrinkles on the articles may exert drag on the cam member 421, thus causing the cam member 421 to be rotated in the counterclockwise direction towards the engaged position. As such, the cam member 421 may engage the articles and retain the articles between the cam member 421 and the second side 40 of the throat 14. However, if the articles have already been inserted far enough down the throat 14 to contact the cutter elements 21, the rotation of the cutter elements 21 may pull one portion of the articles in a downward direction while the other portion is engaged and retained by the cam member 421 against the second side 40 of the throat 14. Accordingly, the articles may tear or the cam member 421 may over-rotate and break. In the embodiment shown in FIG. 24*a*, the springs 420 may compress to compensate for the excess thickness, thus allowing the cam member 421 to disengage from the articles when the articles are being pulled in the downward direction by the cutter elements 21. As discussed above, the outer ring 56*a* of the slip disk 57*a* may also be used as a relief mechanism.

Referring back to FIG. 24*a*, when articles having a thickness equal to or less than the predetermined thickness threshold are able to be further inserted into the throat 14, wrinkles or folds may accumulate on the articles. The wrinkles or folds may exert sufficient drag on the cam member 421 to move the cam member 421 to the engaged position. However, in some situations, the articles may have already been inserted far enough into the throat 14 to contact the cutter elements 21. As such, the rotation of the cutter elements 21 may pull one portion of the articles downward while the other portion may still be engaged between the cam member 421 and the second side 40 of the throat (or the rib structure 432). To prevent the cam member 421 from being dragged further downward into the throat 14 by the articles, the springs 420 may compress, thus moving the sliding frame 410 further into the frame assembly 412 in the direction of A, as shown in FIG. 24*b*, and away from the second side 40 of the throat 14. In the illustrated embodiment, the cam member 421 is attached to the sliding frame 410, and thus the cam member 421 also moves with the sliding frame 410 further away from the second side 40 of the throat 14 in the direction of A. This may provide relief to the cam mechanism 423, as the cam member 421 of the cam mechanism 423 may thus be disengaged from the articles and is no longer being pulled further downward into the throat 14 by the articles. However, "disengaged" does not necessarily mean that the cam mechanism 423 is moved to the disengaged position, as shown in FIG. 23*a*. Rather, "disengaged" means that the cam member 421 of the cam mechanism 423 is no longer engaging the articles with such force such that the articles may over-rotate or drag the article further down into the throat 14. Thus, the relief mechanism, or springs 420 in this embodiment, enables the articles that are already contacting the cutter elements 21 to "slip out" or be disengaged from the engaged position between the cam member 421 of the cam mechanism 423 and the second side 40 of the throat 14 (or the rib structure 432) so that the articles can be shredded.

The cam mechanism 23, 223, 323, 423 and/or thickness detector 250, 2350 and blocking member 256, 2356 configurations may optionally be used in other machines or assemblies. For example, the cam mechanism 23, 223, 323, 423 and/or the thickness detector 250, 2350 and blocking member 256, 2356 configurations may be provided and used to prevent the insertion of articles that are above the predetermined thickness threshold into binding machines, laminators, hole punching machines, or other machines.

It is contemplated that in some embodiments, the shredder 10 may also include an indicator (not shown) configured to indicate the insertion into the throat 14 of articles above the predetermined maximum thickness threshold. The indicator may be an LED, an audible alarm, or other feedback mechanisms known in the art. The indicator may be activated by the activation of the blocking members 256, 2356. For example, the indicator may be activated when the blocking member 256, 2356 is in the extended position. The indicator may also be activated by the movement of the cam mechanism 23, 223, 323, 423 to the engaged position.

It is also contemplated that audible signals may be generated in response to the insertion of articles above the predetermined thickness threshold. In one embodiment, the indicator is an audible alarm. Examples of audible signals include, but are not limited to beeping, buzzing, and/or any other type of signal that will alert the user that the stack of documents or other article that is about to be shredded is above a predetermined maximum thickness and may cause the shredder mechanism 20 to jam. Reference may be made to U.S. Patent Application Publication No. 2006-0219827 A1, which is hereby incorporated by reference, for details of warning signals that may be given.

The foregoing illustrated embodiments have been provided to illustrate the structural and functional principles of the present invention and are not intended to be limiting. To the contrary, the present invention is intended to encompass all modifications, alterations and substitutions within the spirit and scope of the appended claims.

What is claimed is:

1. A shredder comprising:

a housing having a throat for receiving at least one article to be shredded;

a shredder mechanism received in the housing and including an electrically powered motor and cutter elements, the shredder mechanism enabling the at least one article to be shredded to be fed into the cutter elements and the motor being operable to drive the cutter elements so that the cutter elements shred the at least one article fed therein;

a cam mechanism provided in the throat, the cam mechanism being biased to a disengaged position and movable to an engaged position responsive to insertion into the throat of the at least one article above a predetermined maximum thickness threshold by engagement of the at least one article, wherein the cam mechanism is configured such that in the engaged position the cam mechanism engages the at least one article to prevent further insertion thereof into the throat, and in the disengaged position the cam mechanism is disengaged from the at least one article to permit further insertion thereof into the throat; and wherein the cam mechanism comprises a relief mechanism operative to prevent the cam mechanism from being moved further into the throat when in the engaged position.

2. The shredder of claim 1, wherein the relief mechanism comprises tension springs constructed and arranged to enable movement of the cam mechanism in a direction generally perpendicular to a direction of insertion of the articles into the throat.

3. The shredder of claim 1, wherein the shredder comprises two sets of cutter elements, the two sets of cutter elements converging at a convergence point, and wherein the shredder further comprises a rib structure configured to direct the articles towards the convergence point of the cutter elements.

4. The shredder of claim 3, wherein the rib structure is further configured to contact the cam mechanism to prevent further movement of the cam mechanism into the throat towards the cutter elements.

* * * * *